United States Patent [19]

Tajima

[11] Patent Number: 4,966,051

[45] Date of Patent: Oct. 30, 1990

[54] EFFECT TONE GENERATING APPARATUS

[75] Inventor: Youichiro Tajima, Tokyo, Japan

[73] Assignee: Casio Computer Co., Ltd., Tokyo, Japan

[21] Appl. No.: 290,231

[22] Filed: Dec. 22, 1988

[30] Foreign Application Priority Data

| | | | |
|---|---|---|---|
| Dec. 28, 1987 | [JP] | Japan | 62-335212 |
| Dec. 28, 1987 | [JP] | Japan | 62-200343[U] |
| Dec. 28, 1987 | [JP] | Japan | 62-200344[U] |
| Dec. 28, 1987 | [JP] | Japan | 62-200815[U] |
| Dec. 28, 1987 | [JP] | Japan | 62-200816[U] |

[51] Int. Cl.[5] ..... G10H 1/057; G10H 1/46

[52] U.S. Cl. ..... 84/663; 84/665

[58] Field of Search ..... 84/1.01, 1.03, 1.11–1.13, 84/1.19–1.28, 626–633, 662–665, 701–711, DIG. 4, DIG. 5, DIG. 16, DIG. 26

[56] References Cited

U.S. PATENT DOCUMENTS 4,528,885 7/1985 Chihana ..... 84/1.27 X

OTHER PUBLICATIONS

Technics Human Electronics, SX-K700/K500, Technics PCM Keyboard, Sep. 6, 1987.

*Primary Examiner*—Stanley J. Witkowski

*Attorney, Agent, or Firm*—Frishauf, Holtz, Goodman & Woodward

[57] ABSTRACT

An effect tone generating apparatus can generate an effect tone of an appropriate pattern such as the murmur of a brook or songs of birds, at an arbitrary timing with a simple operation. Since the tone volume of an effect tone can be gradually increased or decreased and the tone volume can be independently controlled in units of channels using a plurality of channels, the audible impressions created by the effect tones can be improved.

22 Claims, 26 Drawing Sheets

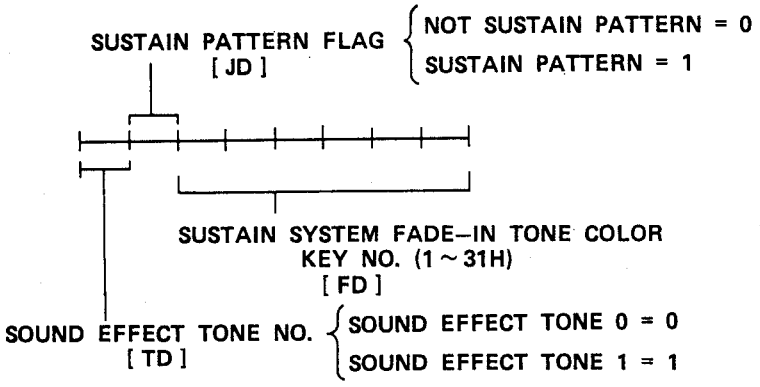
FIG.18
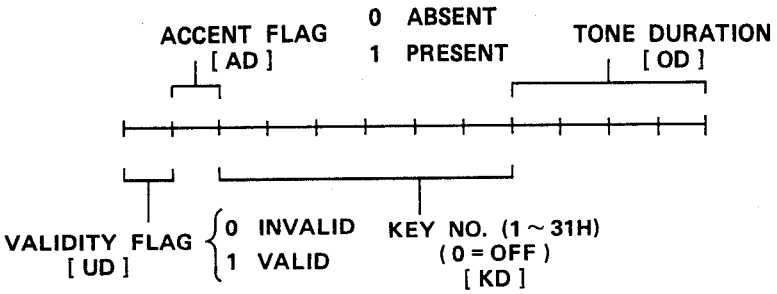
FIG.19
| | | | | | |
|---|---|---|---|---|---|
| 0 | PATTERN END | 6 | 6 | C | 12 |
| 1 | 1 SEC. | 7 | 7 | D | 13 |
| 2 | 2 | 8 | 8 | E | 14 |
| 3 | 3 | 9 | 9 | F | 15 |
| 4 | 4 | A | 10 | | |
| 5 | 5 | B | 11 | | |
FIG.20

| |
|---|
| WAVEFORM ADDRESS FOR LEFT |
| WAVEFORM ADDRESS FOR RIGHT |
| PITCH ENVELOPE DATA FOR LEFT |
| PITCH ENVELOPE DATA FOR RIGHT |
| ENVELOPE DATA FOR LEFT |
| ENVELOPE DATA FOR RIGHT |

| ADDRESS Y | STEP | SUSTAIN | LEVEL (L) | RATE |
|---|---|---|---|---|
| LEFT | 1 | | 10 (TIME) | |
| | 1 | | 99 | +88 |
| | 2 | 1 | 60 | −80 |
| | 3 | | 0 | −70 |
| | 4 | | 0 | 0 |
| | 5 | | 0 | 0 |
| | 6 | | 0 | 0 |
| | 7 | | 0 | 0 |
| RIGHT | 1 | | 10 (TIME) | |
| | 1 | | 99 | +88 |
| | 2 | 1 | 60 | −80′ |
| | 3 | | 0 | −70 |
| | 4 | | 0 | 0 |
| | 5 | | 0 | 0 |
| | 6 | | 0 | 0 |
| | 7 | | 0 | 0 |

EFFECT TONE GENERATING APPARATUS

BACKGROUND OF THE INVENTION

1. Field of the Invention

The present invention relates to a technique for automatically generating an effect tone representing a scene.

2. Description of the Related Art

Conventionally, when effect tones such as the murmur of a brook, the chirping of a bird, and the like, representing a forest scene are to be listened to, a magnetic tape or record disk which records such tones in the forest is reproduced using an audio system. The effect tones also include tones representing a seashore scene, street scene, concert hall scene, and the like. These effect tones are reproduced solely or in synchronism with an image or music, thus creating a scene.

However, in a conventional effect tone generating apparatus, the effect tones recorded on a magnetic tape or record disk have a limited duration, and cannot be reproduced for a long period of time. For example, the chirping of a bird cannot be obtained at a desired timing. It is not also easy to quickly switch effect tones from an ocean scene to a forest scene in synchronism with a TV image. In addition, the entire system becomes bulky, and requires a mechanical portion. Thus, maintenance is necessary.

An electronic musical instrument which generates an effect tone using sampled tones is known (a keyboard instrument "SX-K700" is available from Technics, Japan). Since this electronic musical instrument has a limited sampling time, it performs loop reproduction. Thus, changes in tone are little, and the reproduced tones sound monotonous due to monaural reproduction.

As another function of an electronic musical instrument, in order to obtain a fade-in/fade-out effect for automatically increasing/decreasing a tone volume, control using a VCA (voltage controlled amplifier) or a fader (volume) with a motor is required.

Such automatic tone volume control allows one to naturally add effect tones to music or image.

However, in the above-mentioned tone volume control, in, e.g., an electronic musical instrument, a VCA circuit must be connected to an output of a sound source circuit, and a control circuit for controlling the control voltage input to the VCA circuit is also necessary. In general, the sound source circuit is digital-controlled by a CPU (central processing unit). However, the VCA circuit is an analog circuit. In order to control the VCA circuit, a D/A (digital-to-analog) converter is required. As a result, the circuit is complicated, and cost is increased.

When the fader with the motor is used in a volume control system, since the system includes a mechanically operating portion, maintenance is required.

When an operator wants to produce effect tones before a performance begins, begin the performance thereafter, and fade out the effect tones during the performance, he or she must perform complicated switching operations, and cannot concentrate on the performance.

SUMMARY OF THE INVENTION

It is therefore an object of the present invention to provide an effect tone generating apparatus which can generate an appropriate effect tone at an arbitrary timing with a simple operation.

It is another object of the present invention to provide an effect tone generating apparatus which can automatically control a tone volume with a simple operation.

According to one aspect of the present invention, there is provided an effect tone generating apparatus comprising: waveform generating means for generating a plurality of waveform data constituting at least one type of effect tone representing a scene; pattern generating means for generating first and second effect tone patterns data indicating generation timings of the waveform data constituting the effect tone for each effect tone of the one type; switch means including a plurality of switches for selecting the effect tone patterns; and pattern selection means for, when a predetermined one of the plurality of switches of the switch means is operated during generation of the effect tone based on the first effect tone pattern output from the pattern generating means, starting generation of the effect tone based on the second effect tone pattern output from the pattern generating means, and for, when a pattern end of the second effect tone pattern comes, restarting generation of the effect tone based on the first effect tone pattern data.

According to another aspect of the present invention, there is provided an effect tone generating apparatus comprising: waveform generating means for generating a plurality of waveform data constituting at least one type of effect tone representing a scene; pattern generating means for generating an effect tone pattern indicating generation timing of the waveform data constituting the effect tone for each effect tone of the one type; switch means including a switch for selecting the effect tone pattern; and pattern selection means for, when no effect tone is generated based on the effect tone pattern and the switch of the switch means is operated, starting generation of an effect tone based on the effect tone pattern output from the pattern generating means, and for, when a pattern end of the effect tone pattern is detected, stopping generation of the effect tone.

According to still another aspect of the present invention, there is provided an effect tone generating apparatus comprising: waveform generating means for generating a plurality of waveform data constituting at least one type of effect tone representing a scene; pattern generating means for generating an effect tone pattern indicating a generation timing of the waveform data from the waveform generating means; tone volume level control means for controlling a tone volume level of the effect tone generated based on the waveform data and the effect tone pattern; and designation means for designating a change state of the tone volume level of the tone volume level control means.

According to a further aspect of the present invention, there is provided an effect tone generating apparatus comprising: waveform generating means for generating a plurality of waveform data constituting at least one type of effect tone representing a scene; pattern generating means for generating an effect tone pattern data indicating a generation timing of the waveform data from the waveform means; envelope waveform generating means for generating an envelope waveform for controlling a tone volume level of the effect tone generated based on the waveform data and the effect tone pattern; and designation means for designating the envelope waveform of the envelope waveform generating means According to still a further aspect of the present invention, there is provided an effect tone generating apparatus comprising: waveform means for generating a plurality of waveform data constituting at least one type of effect tone representing a scene; a plurality of tone field channels to which the waveform data from the waveform means is assigned; envelope waveform generating means for generating an envelope waveform to be independently added to the waveform data for each of the plurality of tone field channels; and tone generation control means for generating the effect tone in which the envelope waveform is added to the waveform data for each of the plurality of tone field channels.

BRIEF DESCRIPTION OF THE DRAWINGS

FIG. 18 shows a format of sound effect header data;

FIG. 19 shows a format of step data;

FIG. 20 is a table showing tone data;

DETAILED DESCRIPTION OF THE PREFERRED EMBODIMENTS

Embodiments of the present invention will now be described with reference to the accompanying drawings. In the first embodiment, an automatic effect tone generating apparatus of the present invention is applied to a 2-channel stereo type electronic musical instrument.

Basic Hardware Arrangement

Figure 1:
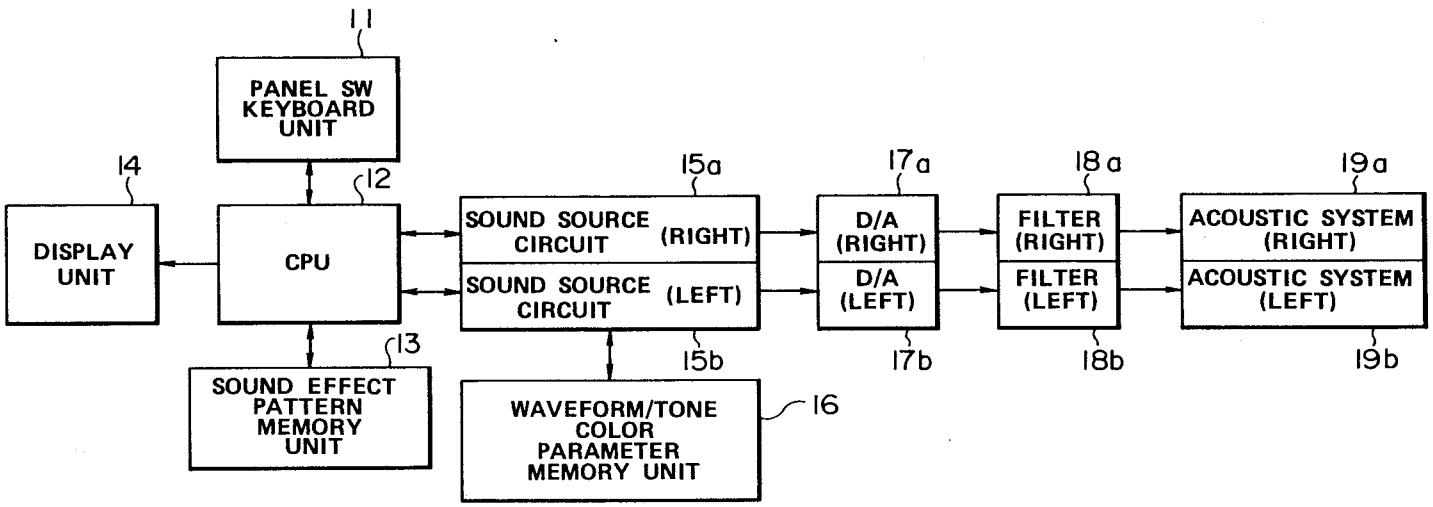
FIG. 1 is a block diagram showing the overall arrangement of an electronic musical instrument according to an embodiment of the present invention.

FIG. 1 shows the overall arrangement of an electronic musical instrument according to an embodiment of the present invention. In FIG. 1, panel switch (SW)/keyboard unit 11 comprises operation panel **11*a* having switches operated for obtaining various sound effects, and keyboard 11*b* having a large number of keys according to various effect tones and pitches. Operation data of the switches and keys are supplied to CPU (Central Processing Unit) 12 through an interface circuit (not shown). Sound effect pattern memory unit 13 is a memory device comprising, e.g., a ROM (Read Only Memory) storing various sound effect pattern data (to be described later). Data is read out from memory unit 13 under the control of CPU 12. Display unit 14 performs various displays under the control of CPU 12. CPU 12 performs arithmetic operations and processing according to a predetermined program based on data from panel SW/keyboard unit 11, sound effect pattern memory unit 13, and the like, and supplies control signals and control data to right- and left-channel tone source circuits 15*a* and 15*b*. CPU 12 comprises various registers (to be described later) for performing the above-mentioned arithmetic operations and processing. Tone source circuits 15*a* and 15*b* are PCM (Pulse Code Modulation) tone source circuits, and supply a read address supplied from CPU 12 to waveform/tone color parameter memory unit 16. Memory unit 16 is a memory device comprising, e.g., a ROM storing waveform and tone color parameter data (to be described later). Digital signals obtained by tone source circuits 15*a* and 15*b* are converted to analog signals by right- and left-channel D/A (digital-to-analog) converters 17*a* and 17*b*, respectively. The analog signals are supplied to right- and left-channel acoustic systems 19*a* and 19*b* through right- and left-channel filters 18*a* and 18*b***, thus stereophonically outputting an effect tone.

Figure 2:
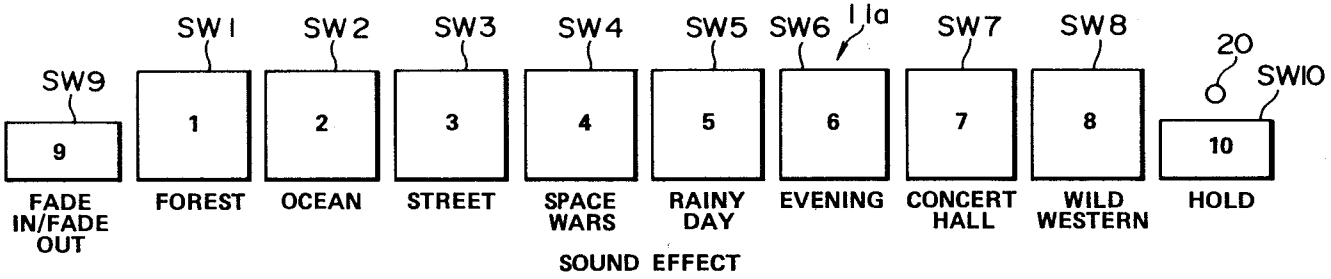
FIG. 2 is a view showing an operation panel shown in FIG. 1.

FIG. 2 shows an arrangement of the operation panel shown in FIG. 1. In FIG. 2, operation panel **11*a*** is a panel operated to obtain an effect tone, and includes a total of ten switches, i.e., sound effect (SOUND EFFECT) switches SW1 to SW8, fade-in/fade-out (FADE-IN/FADE-OUT) switch SW9, and hold (HOLD) ON/OFF switch (to be referred to as hold switch hereinafter) SW10. Sound effect switches SW1 to SW8 are operation switches to which effect tones are assigned such that SW1 corresponds to an effect tone representing a forest scene (FOREST); SW2, an effect tone representing a seashore scene (OCEAN); SW3, an effect tone representing a street scene (STREET); SW4, an effect tone representing the scene of a space war (SPACE WAR); SW5, an effect tone representing the scene of a rainy day (RAINY DAY); SW6, an effect tone representing an evening scene (EVENING); SW7, an effect tone representing the scene of a concert hall (CONCERT HALL); and SW8, an effect tone representing a wild western scene (WILD WESTERN). Fade-in/fade-out switch SW9 is operated in combination with hold switch SW10 so as to gradually increase/decrease a tone volume of an effect tone. LED (Light-Emitting Diode) 20 which is turned on/off in correspondence with an on/off operation of switch SW10 and constitutes a part of display unit 14 is arranged above hold switch SW10 in FIG. 2.

Figure 3:
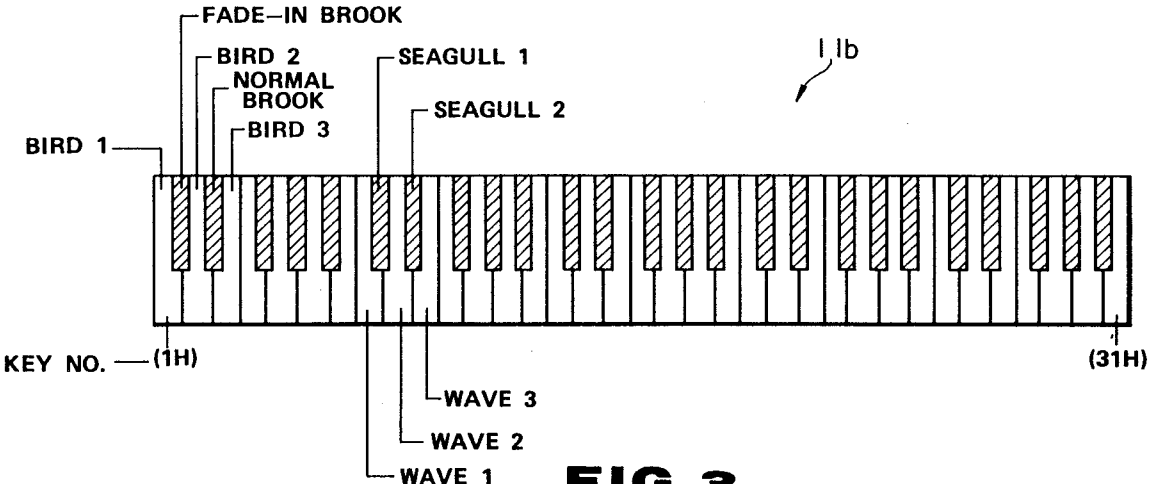
FIG. 3 is a view showing a keyboard shown in FIG. 1.

FIG. 3 shows an arrangement of keyboard 11*b* shown in FIG. 1. In keyboard 11*b*, element tones constituting each effect tone are assigned to keys. When a key is operated, the corresponding element tone can be generated. In keyboard 11*b*, the element tones of the effect tone representing the forest scene include bird 1, fade-in brook, bird 2, normal brook, and bird 3, and element tones of the effect tone representing seashore scene include wave 1, sea gull 1, wave 2, sea gull 2, and wave 3, as shown in FIG. 3. The element tones of the remaining effect tones are assigned to any of keys No. 1 (1H) to No. 31 (31H). Two assignment patterns of the element tones of keyboard 11*b* are available upon switching, as will be described later, and keys can be used for obtaining normal pitches. The element tones are waveforms obtained by PCM sampling. As the waveforms of this embodiment, bird 1, 2, and 3 tones have the same waveform, fade-in and normal brook tones have the same waveform, wave 1, 2, and 3 tones have the same waveform, and sea gull 1 and 2 tones have the same waveform,. The bird and sea gull tones employ one of a number of sampled waveforms, which exhibits the feature of a tone property best. The waveforms of the brook and wave tones include noise components as a main tone property, and are random waveforms. Thus, a waveform group for a predetermined period of time is used as it is, and is loop-processed. Therefore, if this tone is listened to without modification, it sounds like a periodical tone having a given period. Right- and left-channel tone source circuits 17*a* and 17*b* employ the same waveforms described above.

The effect tones representing the forest scene (FOREST) and seashore scene (OCEAN) generated by this embodiment will be described in detail below. The forest effect tone to be described in this embodiment is constituted by element tones of the chirping of birds and the murmur of a brook, and the seashore effect tone is constituted by element tones of waves and songs of sea gulls.

Format of Effect Tone

Envelope data forming each element tone is stored in a predetermined memory area of waveform/tone color parameter memory unit 16, as will be described later in detail. Basically, this envelope is separately used by right- and left-channel tone source circuits 15*a* and 15*b*. In this manner, localization, spread, and perspective sense of tones can be desirably reproduced. Key on delay (time delay) can be performed between right- and left-channel tone source circuits 15*a* and 15*b*.

Figure 4:
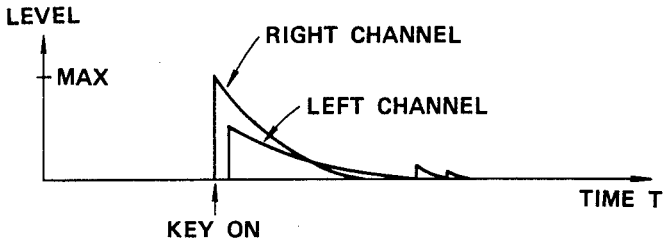
FIG. 4 is a graph showing a bird 1 envelope.

FIG. 4 shows the bird 1 envelopes. In FIG. 4, in the right-channel bird 1 envelope, a tone volume level immediately rises to a maximum (MAX) value upon K on and is slowly decreased to a minimum level, and in the left-channel bird 1 envelope, after a predetermined time delay after Key on of the right-channel envelope, a tone volume level immediately rises to a value half of the maximum value, and is slowly decreased to the minimum level. During decay of each envelope, the envelope includes two small peaks. In the bird 1 envelope, for localization of tone, since the tone volume level of the right channel is higher than that of the left channel, it can be heard as if a bird sings at a position between the center and the right-channel (a position slightly shifted to the right from the center). Since the left-channel envelope is subjected to Key on time delay with respect to the right-channel envelope, a reproduced tone can be heard with a sense of spread, and two small peaks during decay provide an effect of echoes in the forest.

Figure 5:
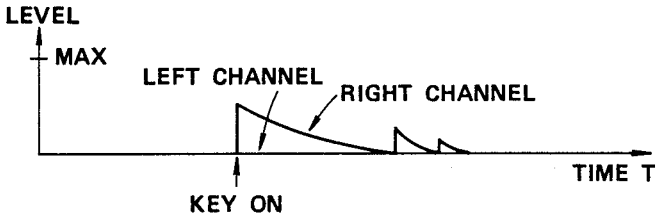
FIG. 5 is a graph showing a bird 2 envelope.

FIG. 5 shows bird 2 envelopes. In FIG. 5, in the right-channel bird 2 envelope, a tone volume level immediately rises to a value half of the maximum value upon key on, and is slowly decreased to the minimum level. In the left-channel envelope, after the right-channel envelope reaches the minimum level, two small peaks successively appear. In the bird 2 envelopes, a bird sings to be localized at a slightly far position near the right channel, and thereafter, the two peaks of the left-channel envelope provide an effect of echoes of the forest.

Figure 6:
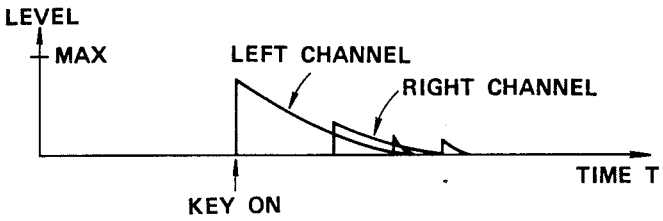
FIG. 6 is a graph showing a bird 3 envelope.

FIG. 6 shows bird 3 envelopes. In FIG. 6, in the left-channel bird 3 envelope, the tone volume level immediately rises to a value slightly lower than the maximum value upon Key on, and is slowly decreased to the minimum level. In the right-channel envelope, the tone volume level immediately rises low after the lapse of a given delay time, and is then slowly decreased to the minimum level. During decay of each envelope, a small peak appears. In the bird 3 envelopes, a bird first sings near the left channel, the other bird sings at a distance on the right channel, and an effect of echoes of the forest is also provided.

Figure 7:
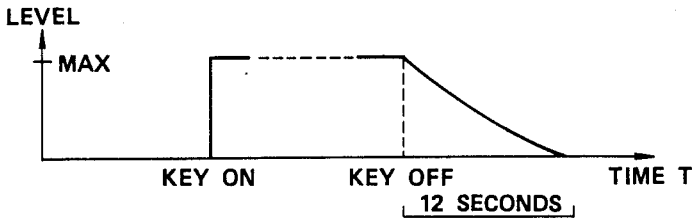
FIG. 7 is a graph showing a normal brook tone envelope.
Figure 8:
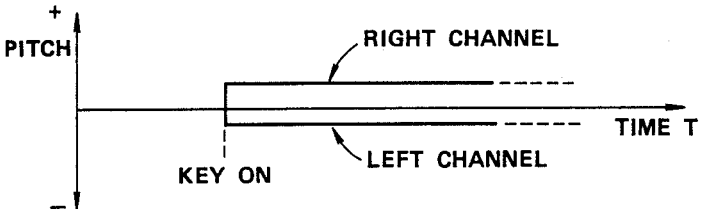
FIG. 8 is a graph showing a change in pitch of the normal brook tone envelope.
Figure 9:
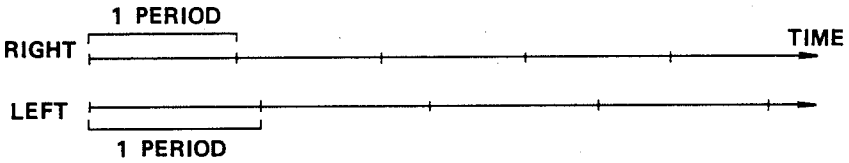
FIG. 9 is a chart showing a period of the normal brook tone.

FIG. 7 shows a normal brook envelope. In FIG. 7, in the normal brook envelope for the right and left channels, the tone volume level rises to the maximum value upon Key on, and thereafter takes a constant value, i.e., provides a continuous tone having a sustain point. After Key off, the tone volume level is slowly decreased in 12 seconds and reaches the minimum level. In the normal brook envelope, since the normal brook tone is the main element of the forest scene, a continuous tone is kept generated to be localized at the center. The brook waveform provides a tone having a predetermined period, and the reproduced tone sounds unnatural as it is. Therefore, as shown in FIG. 8, with respect to a value having a pitch of a predetermined level, a tone for the right channel is offset to a positive side, and a tone for the left channel is offset to a negative side. When the pitches are changed for the right and left channels as described above, the periods of the right and left channels have different durations, as shown in FIG. 9. Therefore, the right- and left-channel periods are shifted from each other. When a person hears the brook tone based on this envelope, he or she does not feel unnaturalness caused by a constant period. A tone obtained with this method includes a noise component as a major component, which cannot be reproduced by loop reproduction of a single waveform, and is best suited for a tone for which a pitch is not important unlike an effect tone. In this embodiment, the pitches are offset constantly along the time base. If right- and left-channel pitches are independently changed over time, periodicity does not appear, and a reproduced tone sounds more natural.

Figure 10:
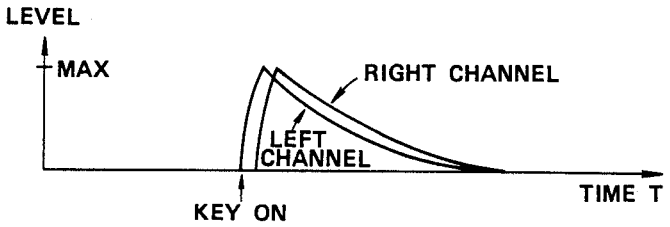
FIG. 10 is a graph showing a wave 1 envelope.

FIG. 10 shows wave 1 envelopes. In FIG. 10, in the left-channel wave 1 envelope, a tone volume level rises to a maximum value in a relatively short period of time after Key on, and thereafter, is slowly decreased to the minimum level. In the right-channel envelope, the tone volume level rises to the maximum value after a short delay time from the left-channel envelope, and is slowly decreased to the minimum level. In the wave 1 envelopes, wave tones are localized at the center, and a person can hear the wave tones breaking near him or her with a sense of spread.

Figure 11:
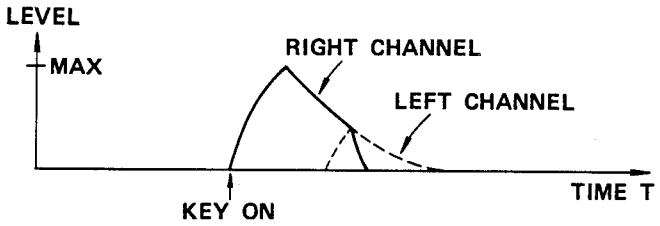
FIG. 11 is a graph showing a wave 2 envelope.

FIG. 11 shows wave 2 envelopes. In FIG. 11, in the right-channel wave 2 envelope, the tone volume level rises to a maximum value after Key on. Then, the tone volume level is slowly decreased, and is immediately decreased to the minimum level from a halfway point. In the left-channel envelope, before the tone volume level of the right channel is immediately decreased from the halfway point, the tone volume level rises. When the tone volume level reaches that of the right channel, it is slowly decreased to the minimum level. That is, the envelopes are determined such that the left-channel decay envelope (indicated by a dotted curve) naturally follows the right-channel envelope (indicated by a solid curve) from a point halfway of its decay. In the wave 2 envelopes, a wave tone image is shifted from the right channel to the left channel, thus reproducing movement of waves lapping the seashore.

Figure 12:
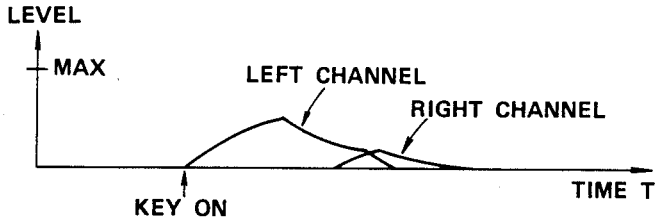
FIG. 12 is a graph showing a wave 3 envelope.

FIG. 12 shows wave 3 envelopes. In FIG. 12, after Key on, the tone volume level is slowly increased, and rises to a value half of the maximum value. Thereafter, the tone volume level is slowly decreased, and is relatively rapidly decreased to the minimum level from a halfway point. In the right-channel envelope, before the tone volume level of the left channel is decreased from the halfway point, the tone volume level rises. When the tone volume level of the right channel reaches that of the left channel, it is slowly decreased to the minimum level. That is, the envelopes are determined such that the right-channel decay envelope naturally follows the left-channel envelope from a point halfway of its decay. In the wave 3 envelopes, a wave tone image is shifted from the right channel to the left channel, thus reproducing movement of going-down waves.

Figure 13:
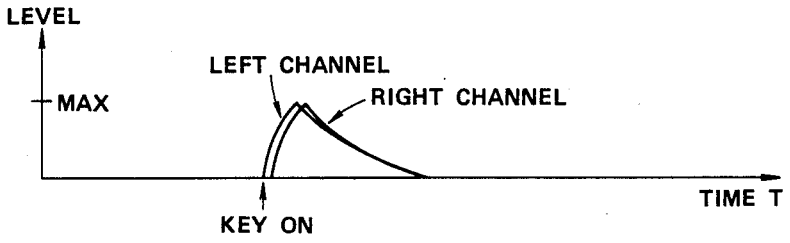
FIG. 13 is a graph showing a sea gull 1 envelope.

FIG. 13 shows sea gull 1 envelopes. In FIG. 13, in the left-channel sea gull 1 envelope, after Key on, the tone volume level rises to the maximum value within a relatively short period of time, and is then slowly decreased to the minimum level. In the right-channel envelope, the tone volume level rises to the same tone volume level as that of the right channel after a short delay time, and is slowly decreased to the minimum level to draw the same waveform curve as that of the left-channel envelope. In the sea gull 1 envelopes, a tone is localized at the center, and a song of the sea gull singing nearby can be reproduced with a sense of spread.

Figure 14:
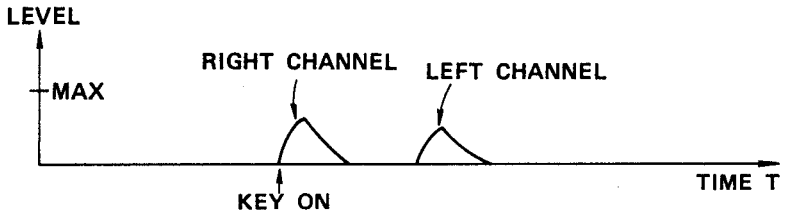
FIG. 14 is a graph showing a sea gull 2 envelope.

FIG. 14 shows sea gull 2 envelopes. In FIG. 14, in the right-channel sea gull 2 envelope, after Key on, the tone volume level rises to a value half of the maximum value, and is then slowly decreased. In the left-channel envelope, a short period of time after the tone volume level of the right channel is decreased, the tone volume level rises along the same waveform as that of the right channel. In the sea gull 2 envelopes, songs of two sea gulls that sing at a distance on the right channel first and then on the left channel can be reproduced.

The above element tones are combined, and are arranged along the time base, thus completing effect tones.

Figure 15:
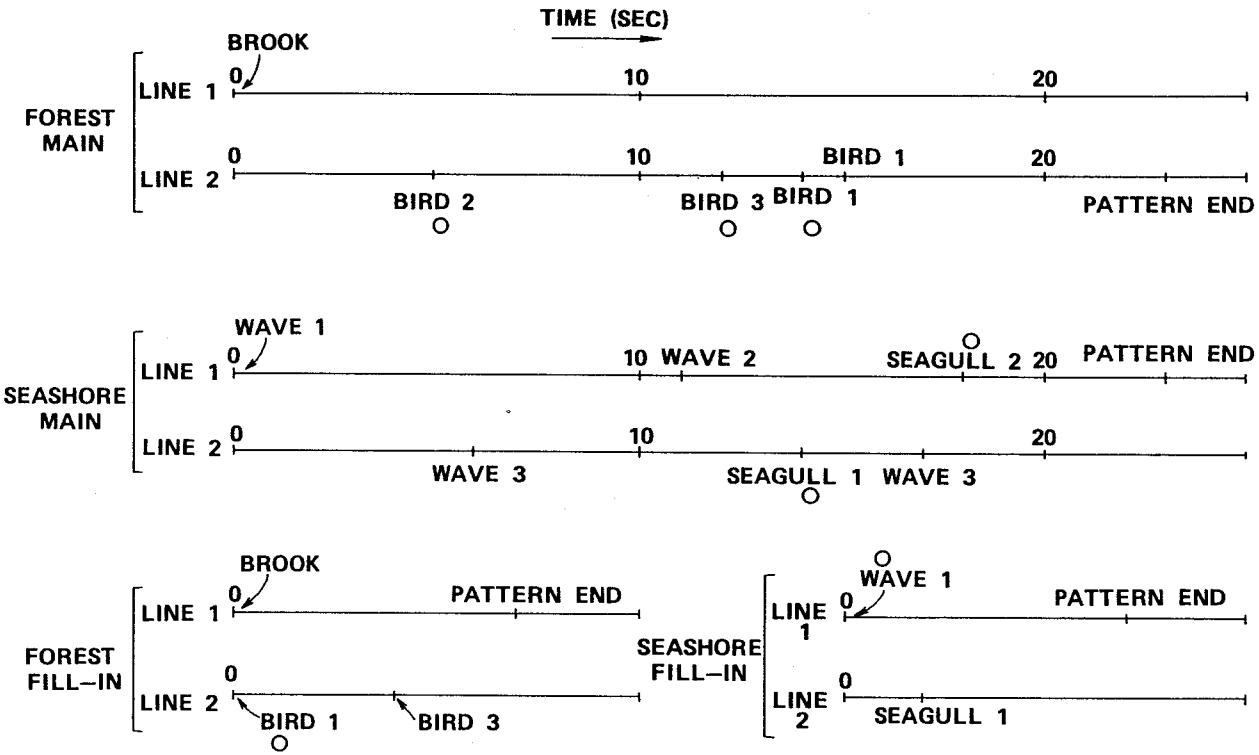
FIG. 15 is a chart showing forest and seashore effect tones.

FIG. 15 is a chart for explaining the effect tones representing the forest scene and the seashore scene. In FIG. 15, the forest and seashore effect tones have a main pattern for obtaining a continuous effect tone and a fill-in pattern for obtaining a short effect tone as needed, as will be described later in detail. Each pattern includes lines 1 and 2. The lines 1 and 2 are a set of patterns used for right- and left-channel tone source 15*a* and 15*b*, respectively, and are effect tone patterns for simultaneously designating and generating two element tones.

An effect tone pattern representing the forest scene will be described first. In the line 1 of the forest main pattern, the normal brook tone begins to be generated. The normal brook tone is continuously generated until designation of the effect tone is canceled. Chirping of birds is scattered along the time base in the line 2 using the normal brook tone in the line 1 as a background tone. More specifically, the bird 2 sings 5 seconds after the normal brook tone begins, the bird 3 sings 7 seconds after the bird 2 sings, bird 1 sings 2 seconds after the bird 3 sings, the bird 1 sings 1 second thereafter, and the pattern end is reached 8 seconds after the bird 1 signs. When the pattern end is reached, the lines 1 and 2 return to the start of patterns. Therefore, the bird 2 signs 13 seconds (8 seconds+5 seconds) after the last bird 1 sings. In this manner, the forest main pattern is repeated with 23-sec periods. In practice, a listener does not notice periodicity if the pattern is repeated with 1- to 2-min periods. For the birds 2, 3, and 1 from the beginning of the line 2, tone volume (accent) designation is made (this designation is indicated by mark "o"; this applies to the following description). In this accent designation, the tone volume level of the element tone is set at one of two (high and low) levels. Thus, a perspective feeling can be provided even if the element tone remains the same, and a variation in tone volume each time a bird sings can be expressed.

In the line 1 of the forest fill-in pattern, the brook tone begins to be generated, and a pattern end is reached in a relatively short period of time, e.g., about 7 seconds. In the line 2, the bird 1 first sings with accent designation, and the bird 3 sings 4 seconds after the bird 1 sings.

An effect tone pattern representing the seashore scene will be explained below. In the forest effect tone, the normal brook tone is kept generated in the line 1. This pattern includes no continuous tone, and is expressed by a combination of element tones. Since waves are lapping the seashore and the shoreline is long, wave tones can always be heard. In order to reproduce this, the coming waves 1 and 2 and the going-down wave 3 tone sound in separate lines. More specifically, in the the line 1 of seashore main pattern, the wave 1 sounds first, the wave 2 sounds 11 seconds after the wave 1 sounds, the sea gull 2 sings with accent designation 7 seconds after the wave 2 sounds, and a pattern end is reached 5 seconds after the sea gull 2 sings. In the line 2, the wave 3 sounds 7 seconds after the wave 1 of the line 1 sounds. The sea gull 1 sings with accent designation 8 seconds after the wave 3 sounds, and the wave 3 sounds 3 seconds after the sea gull 1 sings. In the seashore main pattern, the wave 3 sounds immediately before the wave 1 envelope ends, and transition from the wave 3 to wave 2 and from the wave 2 to wave 3 are similarly performed. The position of the pattern end is determined in correspondence with the transition timing from the wave 3 to wave 1.

In the seashore fill-in pattern, the wave 1 sounds with accent designation in the line 1, and the pattern end is reached in a relatively short period of time, e.g., about 7 seconds. In the line 2, the sea gull 1 sings 2 seconds after the wave 1 sounds in the line 1.

In this manner, the element tones of the effect tones are scattered along the time base, so that various scenes can be visualized.

A generation mode of the effect tone upon sound effect switch operations will be described below in units of switch operations.

Generation of Effect Tone by Switch Operation

1. When hold switch SW10 is kept on, if sound effect switch SW1 is depressed, the forest main effect tone pattern is generated; if SW2, the seashore main effect tone pattern; and if SW3 to SW8, corresponding effect tone patterns. With this switch operation, a total of eight effect tone patterns can be selected. In this case, the effect tones are kept generated until hold switch SW10 is turned off, and an operator need not mind at all the duration of use of effect tones unlike in the conventional system.

2. When hold switch SW10 is kept off, if sound effect switch SW1 is depressed, the forest fill-in effect tone pattern is generated; if SW2, the seashore fill-in effect tone pattern; and if SW3 to SW8, corresponding effect tone patterns. With this switch operation, a total of eight effect tone patterns can be selected. The fill-in effect tone pattern is a short pattern which automatically ends when the pattern end is reached, and is effective when an effect tone is used in a music for the purpose of accent.

3. When hold switch SW10 is kept on and a predetermined effect tone pattern is generated, if one of sound effect switches SW1 to SW8 is depressed, a corresponding short effect tone pattern is generated at that time, and thereafter, an original effect tone pattern is resumed. For example, when the effect tone of this embodiment (forest effect tone) is generated as a background tone of a forest image, if a song of a bird is to be generated when an image is switched to a close shot of a bird, the same sound effect switch SW1 is depressed when the close shot of the bird is displayed. Then the forest fill-in effect tone pattern is generated, and the song of the bird can be filled in.

4. When hold switch SW10 is kept on and no effect tone is generated, if fade-in/fade-out switch SW9 is depressed, the tone volume of a previously selected effect tone is gradually increased, and reaches a normal tone volume level in about 12 seconds (12 seconds+$\alpha$).

5. When hold switch SW10 is kept on and an effect tone is generated, if fade-in/fade-out switch SW9 is depressed, the tone volume of the effect tone is gradually decreased, and a no-tone generation state is established in about 12 seconds (12 seconds+$\alpha$).

Figure 16:
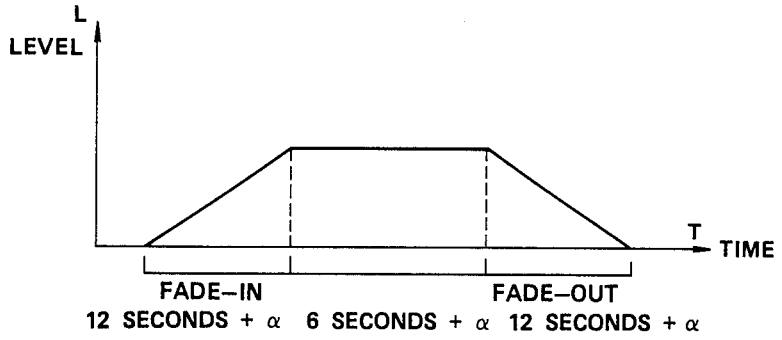
FIG. 16 is a graph showing a transition state from fade-in to fade-out.

6. When hold switch SW10 is kept off and no effect tone is generated, if fade-in/fade-out switch SW9 is depressed, the tone volume of a previously selected effect tone is gradually increased, and reaches a normal tone volume level in about 12 seconds (12 seconds+$\alpha$). The tone volume level is maintained for about 6 seconds (6 seconds+$\alpha$). Thereafter, the tone volume is gradually decreased, and a no-tone generation state is established in about 12 seconds (12 seconds+$\alpha$). FIG. 16 shows the fade-in/fade-out state by the above-mentioned switch operation.

The detailed effect tone generation sequence according to the operation will be described below.

Detailed Effect Tone Generation Sequence

Sound effect pattern data used for generating an effect tone will be explained first.

Figure 17:
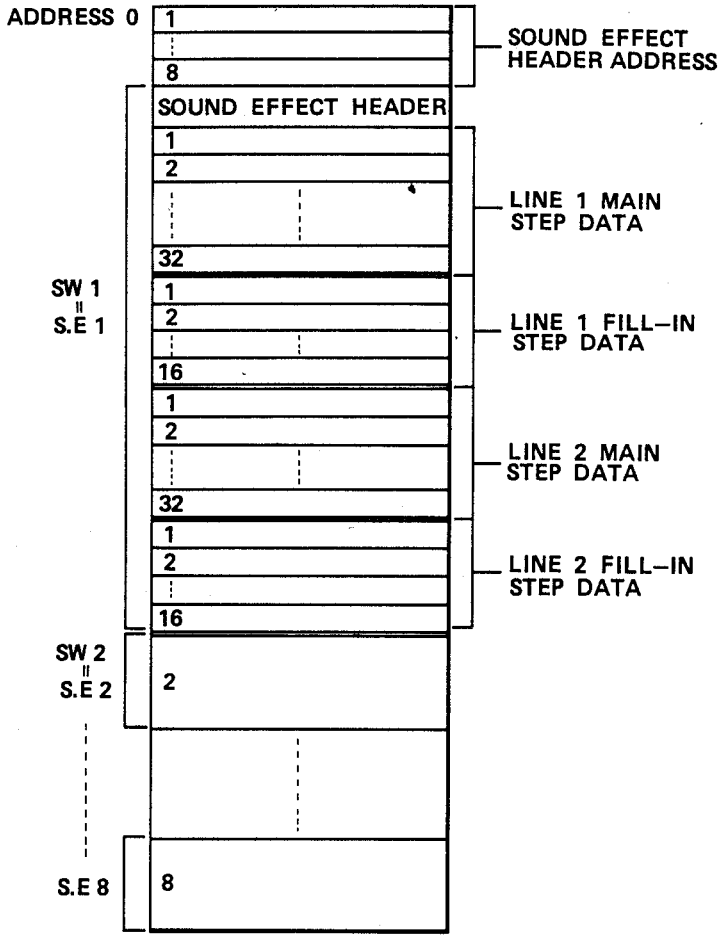
FIG. 17 shows an effect pattern data memory map.

FIG. 17 shows an effect tone pattern data memory map. The memory map shows an internal architecture of sound effect pattern memory unit 13 shown in FIG. 1. Sound effect header address data 1 to 8 indicating start addresses of areas for storing pattern data corresponding to sound effect switches SW1 to SW8 are stored in an area starting from address "0". Areas (S.E1 to S.E8) for storing pattern data in the order of sound effect switches SW1 to SW8 follow the area storing the start addresses. One pattern data consists of one sound effect header data, 32 line 1 main step data, 16 line 1 fill-in step data, 32 line 2 main step data, and 16 line 2 fill-in step data.

FIG. 18 shows the format of the sound effect header data. In FIG. 18, this format is constituted by 8 bits. The start one bit indicates sound effect tone No. data (TD). In this embodiment, two patterns shown in FIG. 3 in which element tones are assigned to keys are used, and are represented by "0" and "1". The next one bit indicates a sustain pattern flag (JD). When one tone (brook tone) is to be kept generated in the line 1 like the forest effect tone pattern, data "1" is set; other-wise like the seashore effect one pattern, data "0" is set. The following 6 bits indicate sustain fade-in tone color key No. data (FD). For example, in the forest effect tone pattern, the data indicates a fade-in brook key number, and is used in fade-in processing to be described in detail later.

FIG. 19 shows the format of the step data. In FIG. 19, this format is constituted by 12 bits. The start one bit indicates a validity flag (UD) and indicates whether a key No. (to be described later) of the corresponding step data is made valid or invalid, that is, whether or not the content of immediately preceding step data is held. If the key is turned on/off, data "1" is set. The next one bit indicates an accent flag (AD), and indicates whether or not an accent is added to the element tone described above). When the accent is added (designated), data "1" is set; otherwise, data "0" is set.

The following 6 bits indicate key No. data (KD), and indicate key numbers (1H to 31H) corresponding to element tones to be turned on. When data "0" is set, the corresponding key is turned off. The following 4 bits indicate tone duration data (OD), and indicate the number of seconds for which the corresponding step is set valid. More specifically, as shown in FIG. 20, time duration data OD indicates a time duration in units of seconds, and data "0" indicates a pattern end.

The data shown in FIGS. 17 to 20 are stored in the ROM as described above. If these data are to be changed by a user, they can be stored in a RAM (Random Access Memory).

Tone color data used for generating an effect tone will be described below.

Figures 21, 22:
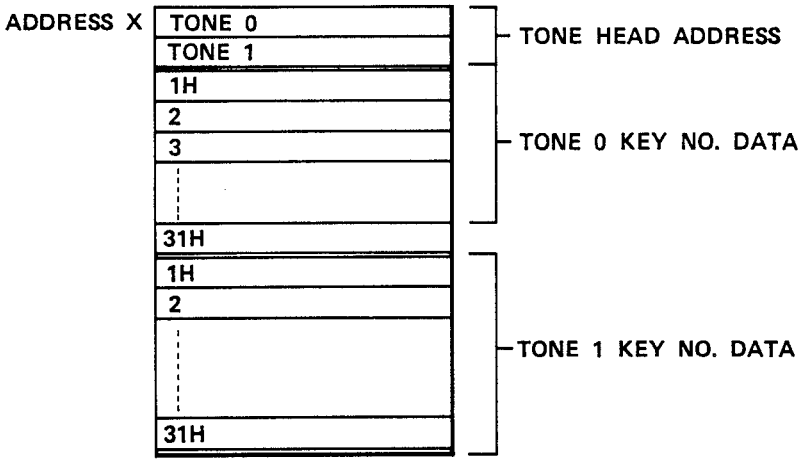
FIG. 21 shows a tone color data memory map.
FIG. 22 is a table showing contents of tone color data.

FIG. 21 shows the tone color data memory map. In FIG. 21, this memory map represents the internal architecture of waveform/tone color parameter memory unit 16 shown in FIG. 1, and stores tone color data from address X of the ROM storing the sound effect pattern data. The memory map includes areas for respectively storing tone head address data, tone 0 key No. data (1H to 31H), and tone 1 key No. data (1H to 31H) in this order starting from address X. The storage area for the tone head address data consists of areas for storing the start addresses of tone 0 and 1 tone color data, respectively.

Figures 23, 24:
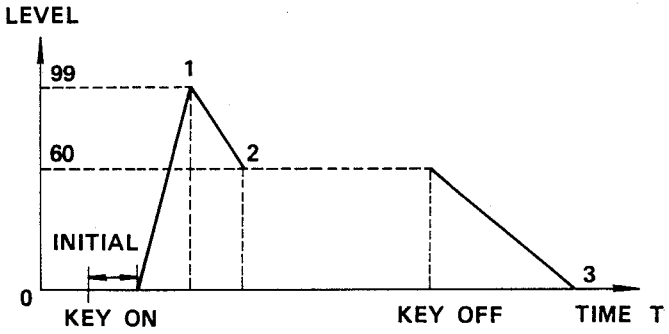
FIG. 23 is a table showing contents of envelope data.
FIG. 24 is a graph showing envelope data shown in FIG. 23.

FIG. 22 shows the content of tone color data. In FIG. 22, the content of the tone color data is constituted by left- and right-channel waveform address data, pitch envelope data, and envelope data. Waveform address data indicates start address data, loop address data, and end address data where the waveform data is stored. In this embodiment, an identical waveform is used. The pitch envelope data is data for controlling a change in pitch over time. The envelope data is data for determining a tone volume data of each element tone. Each of left- and right-channel envelope data is constituted by initial step (I) data and 7 step data, as shown in FIG. 23. The initial step (I) data includes initial time data indicating a delay time after Key on, and each step data consists of a sustain flag, level data, and rate data. More specifically, in FIG. 23, in each of the left- and right-channel envelope data, the initial step (I) data is set to be "10"; in the first step data, level data is set to be "99", and rate data is set to be "+88"; in the second step data, the sustain flag is set ("1"), level data is set to be "60", and rate data is set to be "−80"; in the third step data, level data is set to be "0", and rate data is set to be "−70"; and in the fourth to seventh step data, level data is set to be "0", and rate data is set to be "0".

FIG. 24 shows the content of the envelope data shown in FIG. 23. In FIG. 24, a time period determined by the initial time, i.e., from Key on until the first step is executed is waited. A tone volume level is increased from level "0" to level "99" at a rate of "88" in the positive direction, and is then decreased to level "60" at a rate of "80" in the negative direction. In the second step, since the sustain flag is set, the level is maintained until Key off. In response to the Key off event, the control advances to the third step, and the tone volume level is decreased to level "0" at a rate of "70" in the negative direction, thus completing the control.

Various registers for temporarily storing data in order to obtain the effect tones by arithmetic operations and processing will be explained below. These registers are provided in an internal RAM (not shown) in CPU 12 shown in FIG. 1.

Figure 25:
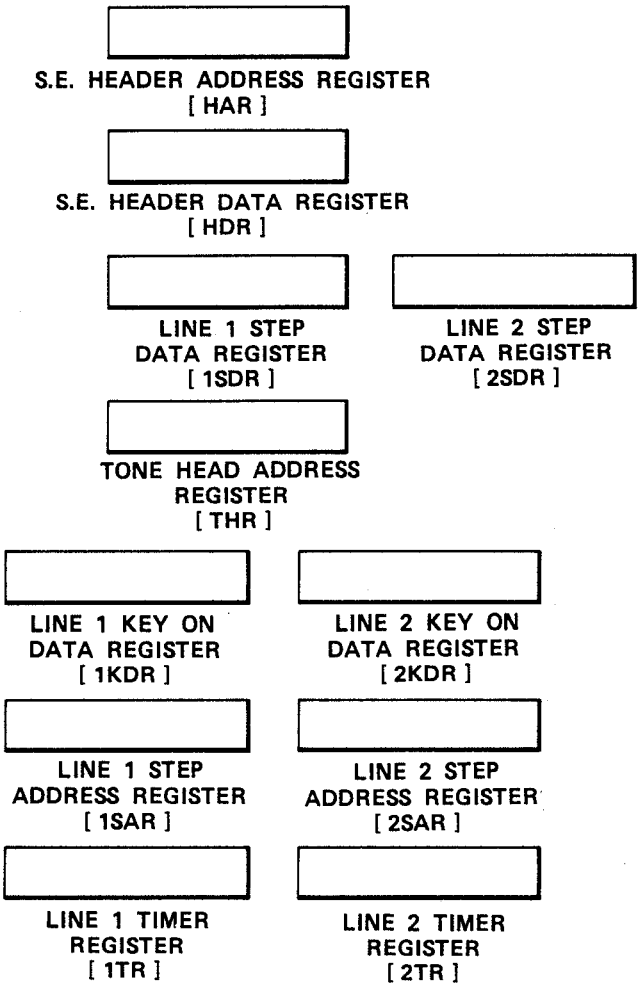
FIG. 25 is a view showing various register groups.
Figure 26:
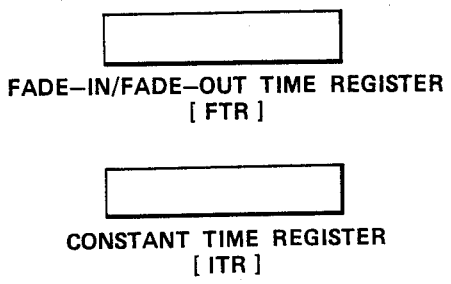
FIG. 26 is a view showing time registers.
Figure 27:
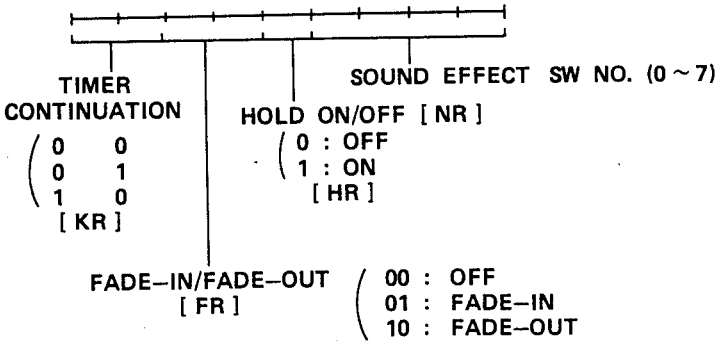
FIG. 27 is a view showing a sound effect register.

FIGS. 25 to 27 are views for explaining the registers. In FIG. 25, a sound effect header address register (HAR) stores present sound effect header address data; a sound header data register (HDR), present header data; a line 1 step data register (1SDR), present line 1 step data; a line 2 step data register (2SDR), present line 2 step data; a tone head address register (THR), present tone head address data; a line 1 Key on data register (1KDR), tone color data generated in the line 1; a line 2 Key on data register (2KDR), tone color data generated in the line 2; a line 1 step address register (1SAR), address data at which present line 1 pattern step data is stored; a line 2 step address register (2SAR), address data at which present line 2 pattern step data is stored; a line 1 timer register (1TR), tone duration remaining time data of the present line 1 step; and a line 2 timer register (2TR), tone duration remaining time data of the present line 2 step.

In FIG. 26, a fade-in/fade-out time register (FTR) stores data for fade-in/fade-out time management; and a constant time register (ITR), data for managing a 6-sec constant level time period after a fade-in operation when hold switch SW10 is kept off and no effect tone is generated and when fade-in/fade-out switch SW9 is depressed.

In FIG. 27, the sound effect register comprises a time continuation register (KR), a fade-in/fade-out register (FR), a hold on/off register (HR), and a sound effect switch No. register (NR). Register KR consists of 2 bits, and indicates a time continuation state. Data "01" in register KR indicates that the line 1 step is inhibited from being advanced by one, "10" indicates that the line 2 step is inhibited from being advanced by one, and "00" indicates that both the line 1 and 2 steps can be advanced.

Register FR consists of 2 bits, and indicates one of fade-in, fade-out, and normal state. Data "01" in register FR indicates the fade-in state, "10" indicates the fade-out state, and "00" indicates an OFF state (normal state). Register HR consists of 1 bit, and indicates a hold ON/OFF state. Data "0" in register HR indicates an OFF state, and data "1" indicates an ON state. Register NR consists of 4 bits, and indicates a No. of the selected sound effect switch. Data "0" to "7" respectively indicate switches SW1 to SW8.

The effect tone generation processing sequence will be described in detail below with reference to the flow charts.

1. Flow chart of Initialization Processing

Figure 28:
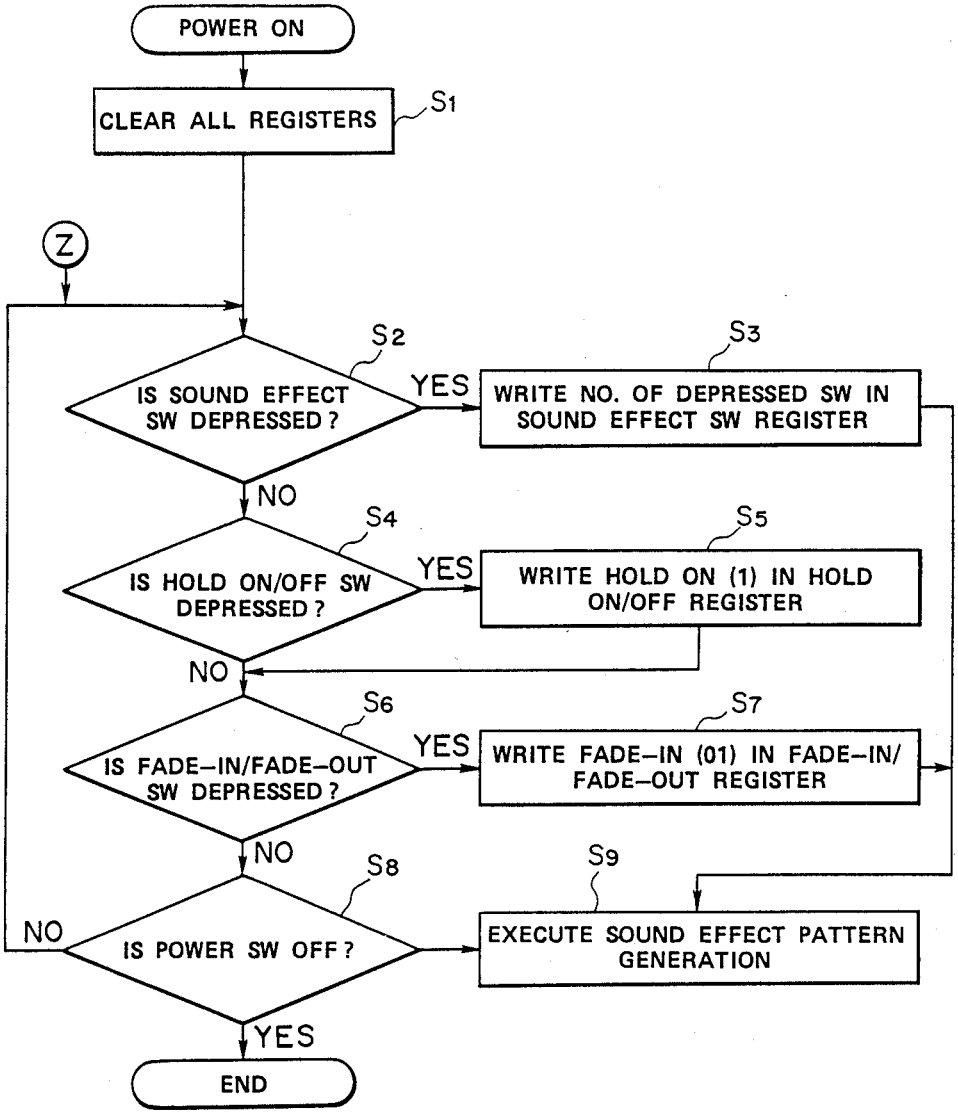
FIG. 28 is a flow chart showing initialization and processing associated with switches.
Figure 29A:
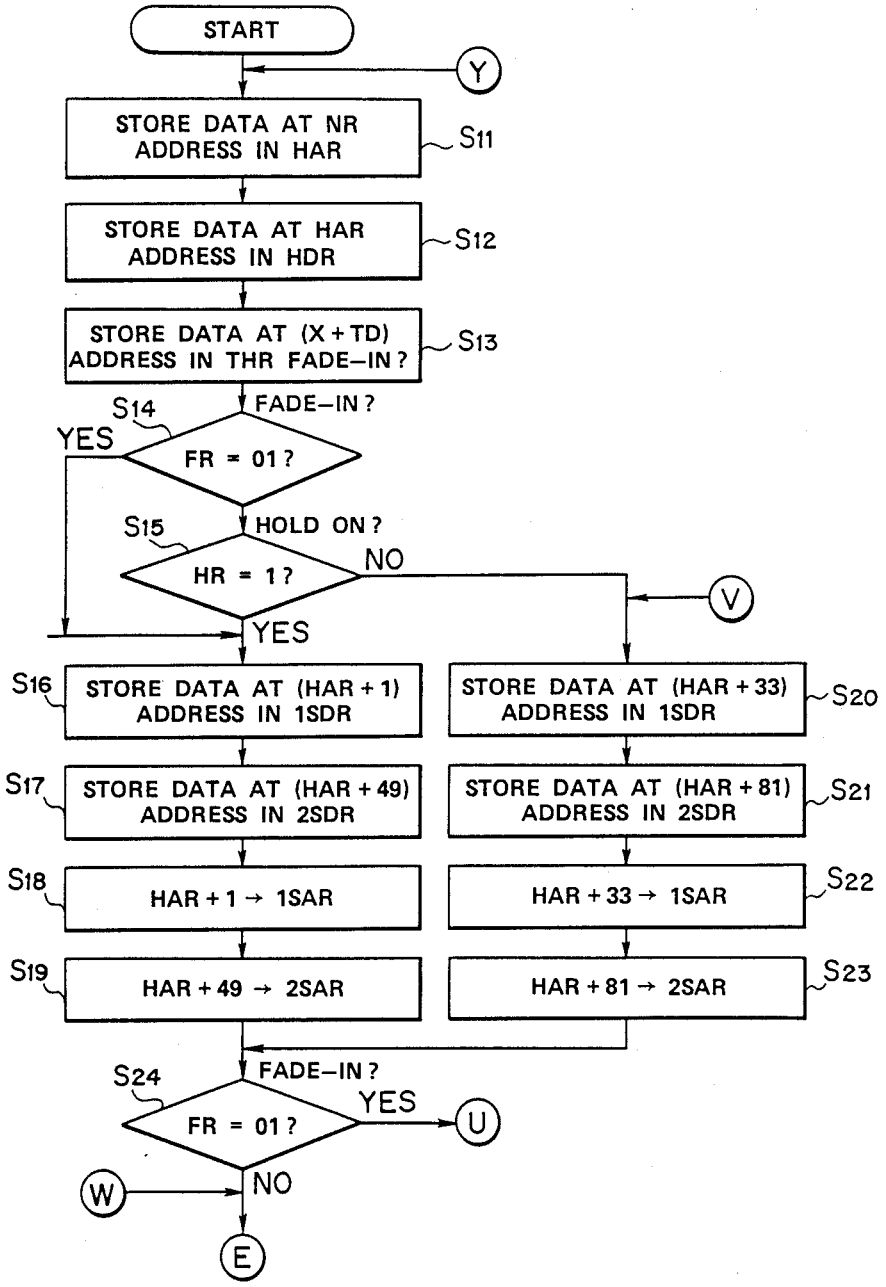
FIGS. 29A and 29B are flow charts showing processing of a normal state.
Figure 29B:
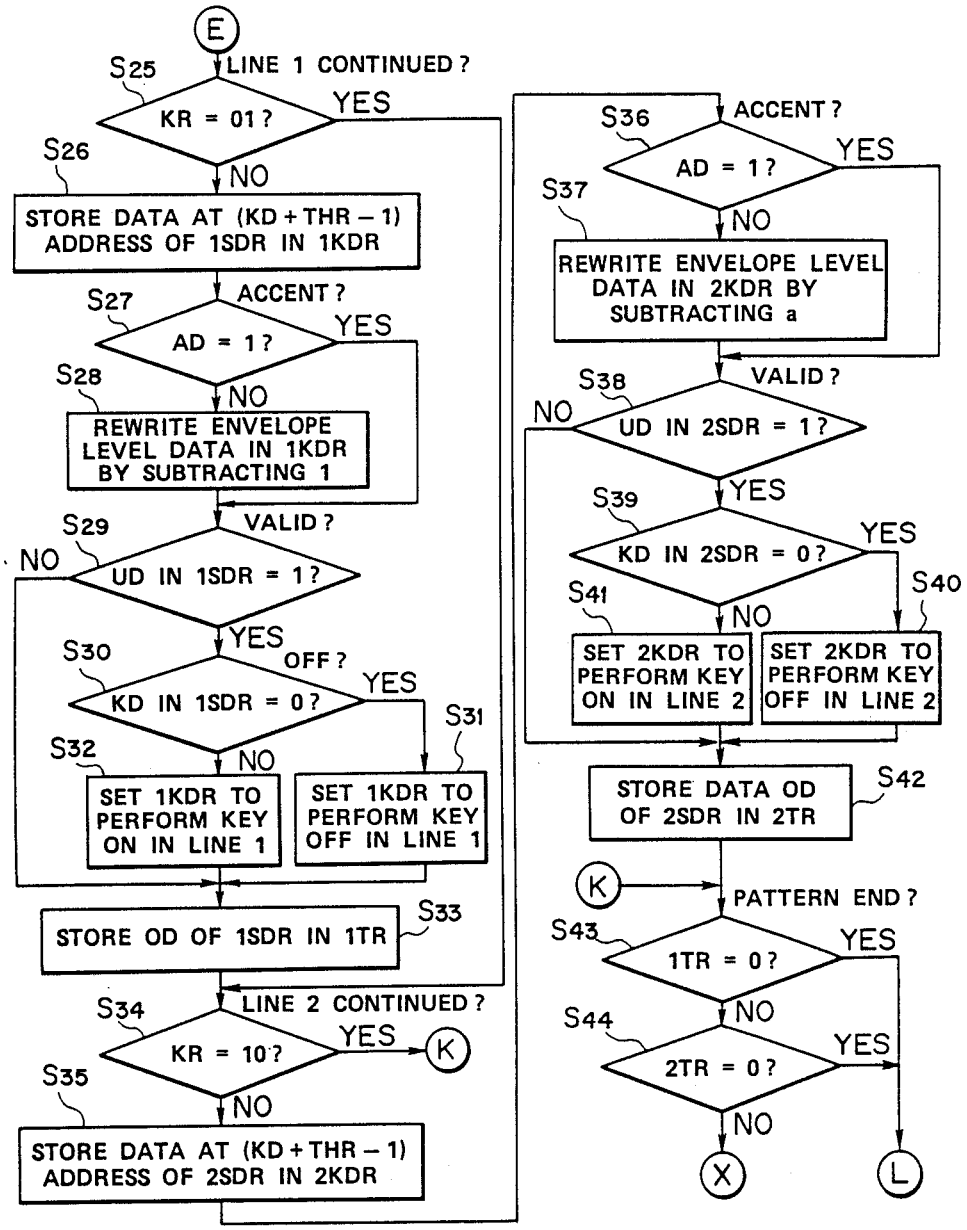

FIG. 28 is a flow chart showing initialization and processing associated with switches. In FIG. 28, when a power switch is ON (power on), the control starts. In step $S_1$, all the registers are cleared. Thus, upon power on, the sound effect register is cleared, register NR is set to be "0", the sound effect switch No. is set to be "1", register HR is set to be "0" indicating the hold off state, and register FR is set to be "00" indicating the normal state. It is checked in step $S_2$ if one of sound effect switches SW1 to SW8 is depressed. If YES in step $S_2$, the No. of the depressed switch is written in the sound effect switch No. register (NR) in step $S_3$; otherwise, it is checked in step $S_4$ if hold ON/OFF switch SW10 is depressed. If YES in step $S_4$, data "1" indicating the hold ON state is written in hold ON/OFF register (HR) in step $S_5$ and the operation advances to step $S_6$; otherwise, the flow directly advances to step $S_6$. If it is determined in step $S_6$ that fade-in/fade-out switch SW9 is depressed, data "01" indicating the fade-in state (hold ON state) is written in the fade-in/fade-out register (FR) in step $S_7$; otherwise, it is checked in step $S_8$ if the power switch is turned off. If NO in step $S_8$, the flow return to step $S_2$, and the same processing is repeated. If YES in step $S_8$, the flow is ended. After the sound effect switch No. or the hold ON state is written in step $S_3$ or $S_5$, sound effect pattern generation processing (to be described later) is executed in step $S_9$. In this processing flow, it is checked if one of switches SW1 to SW10 is depressed, and the presence/absence of the switch operation is checked except for a case wherein when the switch is depressed, the No. of the depressed switch is written in the register and the control advances to the sound effect pattern generation processing.

2. Flow chart of Normal State Processing

FIGS. 29A to 30C are flow charts mainly showing normal state processing. In FIGS. 29A to 30C, in step $S_{11}$, data stored at an NR address is transferred to register HAR. In step $S_{12}$, sound effect header data having the data in register HAR as an address is stored in register HDR. In step $S_{13}$, tone head address data having a value (X+TD) as an address is stored in register THR. More specifically, in steps $S_{11}$ to $S_{13}$, the start address and data of the sound effect pattern are stored in registers HAR and HDR, and the start address of the tone to be used is stored in register THR, thus performing initialization. It is checked in step $S_{14}$ if data FR is "01" (fade-in state). If NO in step $S_{14}$, it is checked in step $S_{15}$ if data HR is "1" (hold ON state). That is, it is checked whether a main or fill-in pattern is used. At this time, the fill-in pattern is used only when a hold OFF state is selected. A case will be described later wherein in the hold ON state, the fill-in pattern is output in response to an ON-event of the sound effect switch. If YES in step $S_{14}$, or if YES in step $S_{15}$, the control enters processing for fetching the main step data. In step $S_{16}$, line 1 main step data having an address obtained by adding "1" to data in register HAR (HAR+1) is stored in register 1SDR. In step $S_{17}$, line 2 main step data having an address obtained by adding "49" to data in register HAR (HAR+49) is stored in register 2SDR. In step $S_{18}$, data obtained by adding "1" to data in register HAR is stored in register 1SAR (HAR +1→1SAR). In step $S_{19}$, data obtained by adding "49" to data in register HAR is stored in register 2SAR (HAR+49→2SAR). If NO in step $S_{15}$, the control enters processing for fetching fill-in step data. In step $S_{20}$, line 1 fill-in step data having an address obtained by adding "33" to data in register HAR (HAR+33) is stored in register 1SDR. In step $S_{21}$, line 2 fill-in step data having data obtained by adding "81" to data in register HAR (HAR+81) as an address is stored in register 2SDR. In step $S_{22}$, data obtained by adding "33" to data in register HAR is stored in register 1SAR (HAR+33→1SAR). In step $S_{23}$, data obtained by adding "81" to data in register HAR is stored in register 2SAR (HAR+81→2SAR). More specifically, in steps $S_{16}$ to $S_{19}$ and steps $S_{20}$ to $S_{23}$, main and fill-in step data and their source addresses are stored in the corresponding registers, thus completing preparation for generating a sound effect pattern.

After step $S_{19}$ or $S_{23}$, it is checked in step $S_{24}$ if data FR is "01" (fade-in state). If YES in step $S_{24}$, the control enters a fade-in processing flow (U) shown in FIG. 31 (to be described later); otherwise, the control enters line 1 tone generation processing. In the line 1 tone generation processing, it is checked in step $S_{25}$ if data KR is "01", that is, the step in the line 1 is not advanced by one but is continued. Since data KR is "00" (NO), an address is calculated based on data KD in register 1SDR and data in register THR (KD+THR−1), and the calculated address data is stored in register 1KDR, in step $S_{26}$. It is checked in step $S_{27}$ if data AD in register 1SDR is "1", that is, if accent designation is made. If NO in step $S_{27}$ (AD=0), level data in the envelope data in register 1KDR is rewritten with a value obtained by subtracting accent value a from the level data in step $S_{28}$. If YES in step $S_{27}$ (AD=1), the level data is kept unchanged, and it is checked in step $S_{29}$ if data UD in register 1SDR is "1" (valid). If YES in step $S_{29}$, it is checked in step $S_{30}$ if data KD in register 1SDR is "0", that is, if OFF data (KD=0) or ON data (KD indicates a key No.) is set. If YES in step $S_{30}$, data in register 1KDR is Keyed off (muting) in the line 1 in step $S_{31}$. If NO in step $S_{30}$, data in register 1KDR is Keyed on (tone generation) in the line 1 in step $S_{32}$. If NO in step $S_{29}$, data OD in register 1SDR is stored in register 1TR in step $S_{33}$ after the processing in step $S_{31}$ or $S_{32}$. More specifically, in $S_{25}$ to $S_{33}$, the line 1 pattern data is fetched, and tone generation or muting is executed.

If YES in step $S_{25}$ or after the processing in step $S_{33}$, the control enters line 2 tone generation processing. It is checked in step $S_{34}$ if data KR is "10", that is, if the step in the line 2 is not advanced by one but is continued. If NO in step $S_{34}$, an address is calculated based on data KD in register 2SDR and data in register THR (KD+THR−1), and the calculated address data is stored in register 2KDR, in step $S_{35}$. It is then checked in step $S_{36}$ if data AD in register 2SDR is "1", that is, if accent designation is made. If NO in step $S_{36}$ (AD=0), level data in envelope data in register 2KDR is rewritten with a value obtained by subtracting accent value a from the level data in step $S_{37}$. If YES in step $S_{36}$ (AD=1), the level data is left unchanged, and it is checked in step $S_{38}$ if data UD in register 2SDR is "1" (valid). If YES in step $S_{38}$, it is checked in step $S_{39}$ if data KD in register 2SDR is "0", i.e., if OFF data (KD=0) or ON data (KD indicates a key No.) is set. If YES in step $S_{39}$, data in register 2KDR is Keyed off (muting) in the line 2 in step $S_{40}$. If NO in step $S_{39}$, data in register 2KDR is Keyed on (tone generation) in the line 2 in step $S_{41}$. If NO in step $S_{38}$, data OD in register 2SDR is stored in register 2TR in step $S_{42}$ after the processing in step $S_{40}$ or $S_{41}$. More specifically, in steps $S_{34}$ to $S_{42}$, the line 2 pattern data is fetched, and tone generation or muting is executed.

If YES in step $S_{34}$, that is, data KR is "10" indicating that the line 2 is continued (K), and after the processing in step $S_{42}$, it is checked in steps S and $S_{44}$ if data in register 1TR is "0" and data in register 2TR is "0", respectively. That is, if the tone duration remaining time of one of the lines 1 and 2 is initially set to be "0", that is, pattern end (YES), the other is also regarded as a pattern end, and the control advances to node (L) in FIG. 30A. If NO in both steps $S_{43}$ and $S_{44}$, the control advances to node (X) in FIG. 30B. That is, if the pattern end is detected, it is checked in step $S_{45}$ if data HR is "1" (hold ON). If YES in step $S_{45}$, data KR is set to be "0" in step $S_{46}$, and the control advances to node (T) to return to step $S_{16}$, thus repeating the same processing as described above. If NO in step $S_{45}$, the lines 1 and 2 are muted in step $S_{47}$, thus completing the sound effect pattern tone generation processing. After step $S_{47}$, the control advances to node (Z) to return to step $S_2$ in FIG. 28, thus executing processing for determining the presence/absence of switch operations.

Figures 30A, 30B:
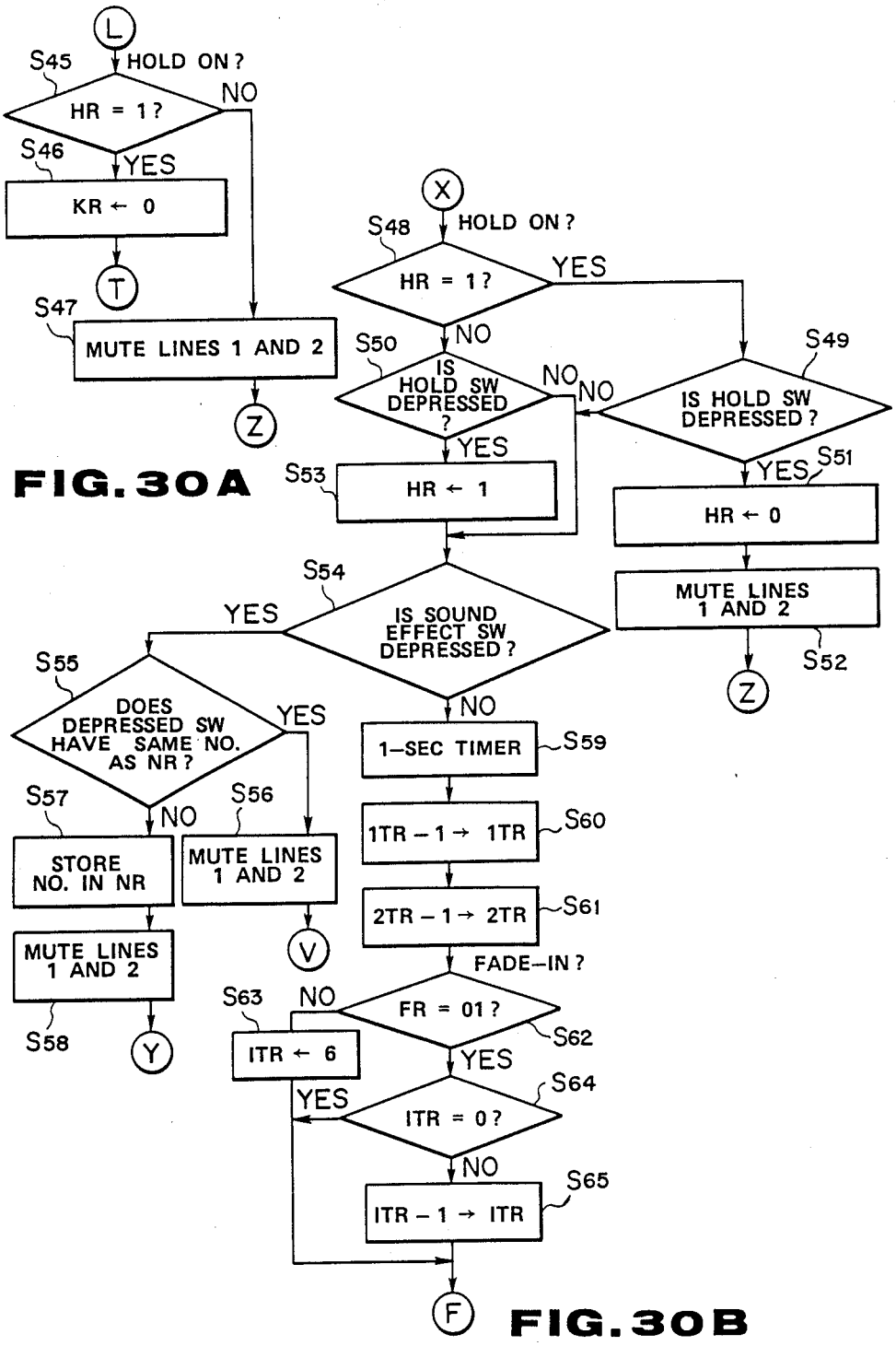
FIGS. 30A to 30C are flow charts showing processing of a normal state.

If NO in both steps $S_{43}$ and $S_{44}$, the control advances to node (X), and it is checked in step $S_{48}$ in FIG. 30B if data HR is "1" (hold ON). When YES or NO is obtained in step $S_{48}$, it is checked in step $S_{49}$ or step S50 if hold switch SW10 is depressed, thereby rewriting data HR. More specifically, when switch SW10 is switched from the hold ON state to the OFF state (steps $S_{48}$ and $S_{49}$), data HR is rewritten to "0" in step $S_{51}$, and the lines 1 and 2 are muted in step $S_{52}$, thus completing the sound effect pattern tone generation processing. Thereafter, the control advances to node (Z). If switch SW10 is switched from the hold OFF state to the ON state (steps $S_{48}$ and $S_{50}$), data HR is rewritten to "1" in step $S_{53}$. If data HR is rewritten to "1" or if switch SW10 is not depressed, it is checked in step $S_{54}$ if one of sound effect switches SW1 to SW8 is depressed. If YES in step $S_{54}$, it is checked in step $S_{55}$ if the depressed switch has the same key No. as that of data NR in the sound effect register. If YES in step $S_{55}$, the lines 1 and 2 are muted in step $S_{56}$, and then, the control advances to node (V)

to return to step $S_{20}$, thus re-executing sound effect pattern tone processing from the beginning of the fill-in pattern. If NO in step $S_{55}$, the key No. of the depressed key is stored in data NR in step $S_{57}$, and the lines 1 and 2 are muted in step $S_{58}$. Thereafter, the control advances to node (Y) to return to step $S_{11}$, thus re-executing the sound effect pattern tone generation processing from the beginning.

If NO in step $S_{54}$, that is, if none of sound effect switches SW1 to SW8 is depressed, 1 second is measured by a 1-sec timer in step $S_{59}$. Thereafter, in steps $S_{60}$ and $S_{61}$, tone duration data stored in registers 1TR and 2TR are updated by subtracting "1" (1TR−1→1TR, 2TR−1→2TR). It is checked in step $S_{62}$ if data FR is "01" (fade-in state). If NO in step $S_{62}$, data "6" is stored in register ITR in step $S_{63}$; otherwise, it is checked in step $S_{64}$ if data in register ITR is "0". If NO in step $S_{64}$, the data in register ITR is updated by subtracting "1" (ITR−1→ITR) in step $S_{65}$. More specifically, in steps $S_{62}$ to $S_{65}$, whether or not the fade-in state is selected is checked to determine if the processing shown in FIG. 16 is being performed. If the processing is being performed and corresponds to a constant time period of 6 seconds, the normal state processing flow is ended while FR="01" is left unchanged; otherwise, since the normal state is set, FR="00". Since the present state is the normal state, the flow advances to the next step without subtracting "1" from data in register ITR. If YES in step $S_{64}'$ that is, data in register ITR is "0", after the processing in step $S_{13}$ or $S_{65}$, it is checked in steps $S_{66}$ and $S_{67}$ if data in registers 1TR and 2TR are "0". That is, whether or not the tone duration times of the corresponding steps have passed is determined. If NO in both steps $S_{66}$ and $S_{67}$, the flow advances to node (X) to return to step $S_{40}$, thus repeating the timer routine described above until the tone duration time of one of the lines 1 and 2 passes. If YES in step $S_{66}$, that is, if data in register 1TR becomes "0", it is checked in step $S_{68}$ if data in register 2TR is "0". If YES in step $S_{68}$, the value in register 1SAR is updated by adding "1" (1SAR+1→1SAR) in step $S_{69}$. In step $S_{70}$, the line 1 step data having the new value of register 1SAR as an address is stored in register 1SDR. In step $S_{71}$, the value in register 2SAR is updated by adding "1" (2SAR+1→2SAR). In step $S_{72}$, the line 2 step data having the new value of register 2SAR as an address is stored in register 2SDR. In step $S_{73}$, data DR is set to be "00". That is, in steps $S_{69}$ to $S_{73}$, the line 1 and 2 step data are advanced by one. If NO in step $S_{68}$, that is, if data in register 2TR is not "0", the value in register 1SAR is updated by adding "1" (1SAR+1→1SAR) in step $S_{74}$. In step $S_{75}$, the line 1 step data having the new value of register 1SAR as an address is stored in register 1SDR. In step $S_{76}$, data KR is set to be "10". That is, data KR is set such that the line 1 step data is advanced by one, and the line 2 continues the timer routine. If YES in step $S_{67}$, that is, if data in register 2TR becomes "0", the value in register 2SAR is updated by adding "1" (2SAR+1→2SAR) in step $S_{77}$. In step $S_{78}$, the line 2 step data having the new value of register 2SAR as an address in register 2SDR. In step $S_{79}$, data KR is set to be "01". That is, data KR is set such that the line 2 step data is advanced by one, and the line 1 continues the timer routine.

Figure 34:
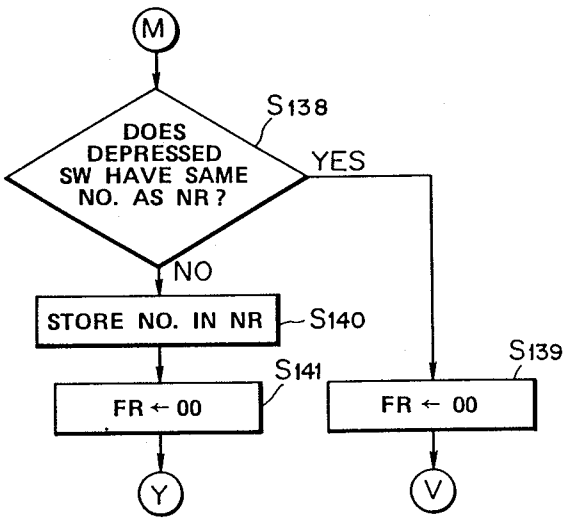
FIG. 34 is a flow chart of fade-out processing.
Figure 33:
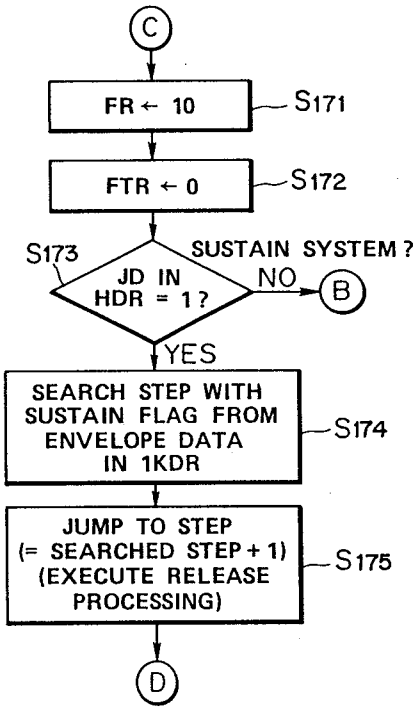
FIG. 33 is a flow chart of fade-in processing.

After steps $S_{73}$, $S_{76}$, and $S_{79}$, it is checked in step $S_{80}$ if data in register ITR is "0" (end of constant time). If NO in step $S_{80}$, it is checked in step $S_{81}$ if fade-in/fade-out switch SW9 is depressed. If NO in step $S_{81}$, the control advances to node (W) to return to step $S_{25}$, thus executing the above-mentioned tone generation processing. If YES in step $S_{80}$, or if YES in step $S_{81}$, the control advances to node (C), and fade-out processing shown in FIG. 34 (to be described later) is executed. More specifically, in steps $S_{80}$ and $S_{81}$ it is checked if the value of register ITR is "0". In the normal state, the value of register ITR is "6", and the flow advances to the next step. Since the present state is the normal state, the fade-out processing is executed if fade-in/fade-out switch SW9 is depressed. If switch SW9 is not depressed, the control returns to the tone generation processing. The normal state processing flow has been described.

Fade-in/fade-out processing will be described below. First, the summary of this processing will be described.

3. Summary of Fade-in/fade-out Processing

As described above with reference to the forest and seashore effect tone patterns, two states are present for the line 1. In one state, one element tone (e.g., a brook tone) is kept generated throughout the pattern. In the other state, various element tones, e.g., wave tones and sea gull tones are generated at predetermined timings as in the line 2. A difference between these states is determined by sustain pattern flag JD in register HDR. In order to perform fade-in/fade-out processing without using an external VCA, the above-mentioned two states must be separately processed.

Figure 35:
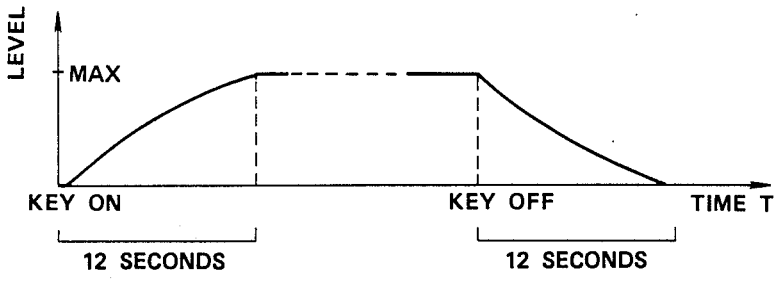
FIG. 35 is a graph showing a brook tone fade-in envelope.

Fade-in processing of the former sustain pattern can be realized as follows. That is, a fade-in tone color is prepared in addition to a normal tone color, and when fade-in switch SW9 is depressed, Key on of the fade-in tone color is performed. FIG. 35 shows an envelope of a fade-in brook tone as an example of the fade-in tone color. As shown in FIG. 35, in an attack envelope of this tone color, a tone volume level is gradually increased upon Key on, and a very long period of time, that is, 12 seconds are required for rising the tone volume level to a maximum sustain level. A fade-in time can be adjusted by changing the attack envelope.

Fade-out processing of the former sustain pattern is performed such that when fade-out switch SW9 is depressed, an envelope to be controlled is shifted to a release envelope. As shown in FIGS. 7 and 35, a time required from Key off of the release envelope until the tone volume level is decreased to "0" is set to be 12 seconds. In this embodiment, the release envelope is used as a fade-out envelope. The envelope to be controlled may be shifted to a special-purpose fade-out envelope simultaneously with Key off (fade-out ON).

The summary of fade-in processing of the latter sustain pattern will be described below.

Figure 36:
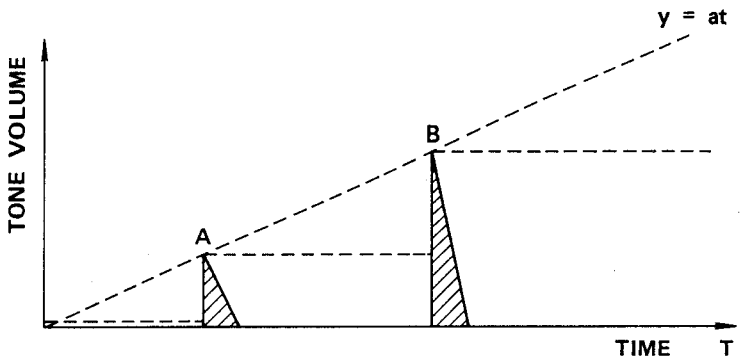
FIG. 36 is a graph showing non-continuous fade-in envelope processing.
Figure 38:
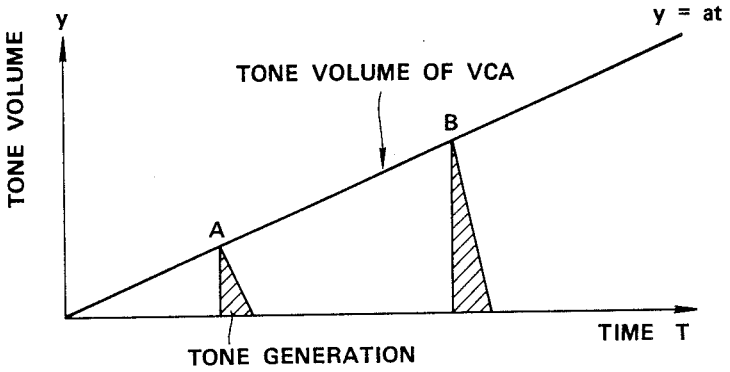
FIG. 38 is a graph showing fade-in processing by a conventional VCA.

FIG. 38 shows fade-in processing using a conventional VCA. As shown in FIG. 38, in fade-in processing of a tone which is not continuously generated, a tone volume need not always be continuously changed, and a corresponding tone volume can be changed at points A and B. In this invention, as shown in FIG. 36, control is made such that the envelope levels of generated tones A and B are aligned along a straight line of $y=at$ (a is a gradient, and t is a time). In this case, a tone volume increment curve is given by $y=at$. However, another curve, e.g., an exponential curve, may be set as long as a generated tone sounds natural. In this embodiment, as a method of controlling the envelope levels on the line given by $y=at$, $a(tmax-t)$ is subtracted from the tone color envelope value. In this case, tmax indicates a maximum value of a change time.

Fade-out processing of the sustain pattern is performed by subtracting at. The detailed flow of the fade-in/fade-out processing will be explained below.

4. Fade-in/fade-out Processing Flow Chart

Figure 31A:
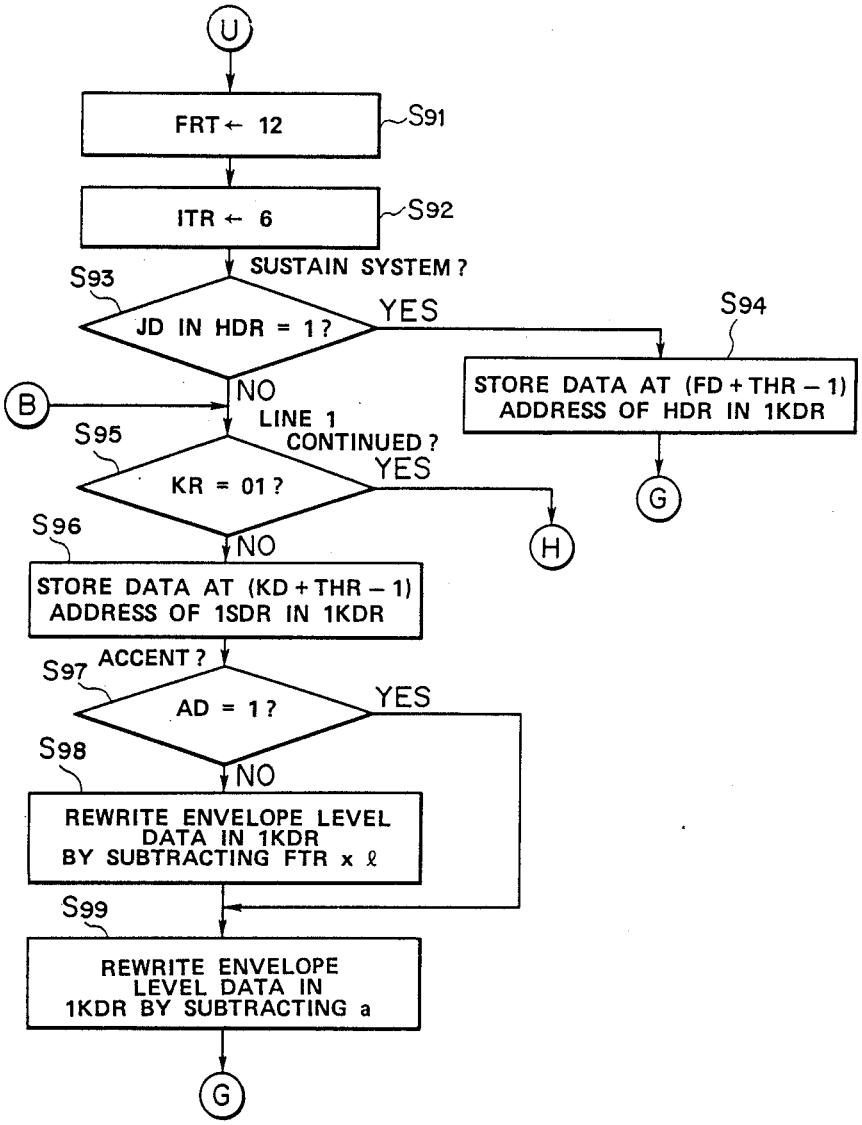
FIGS. 31A and 31B are flow charts of fade-in processing.
Figure 31B:
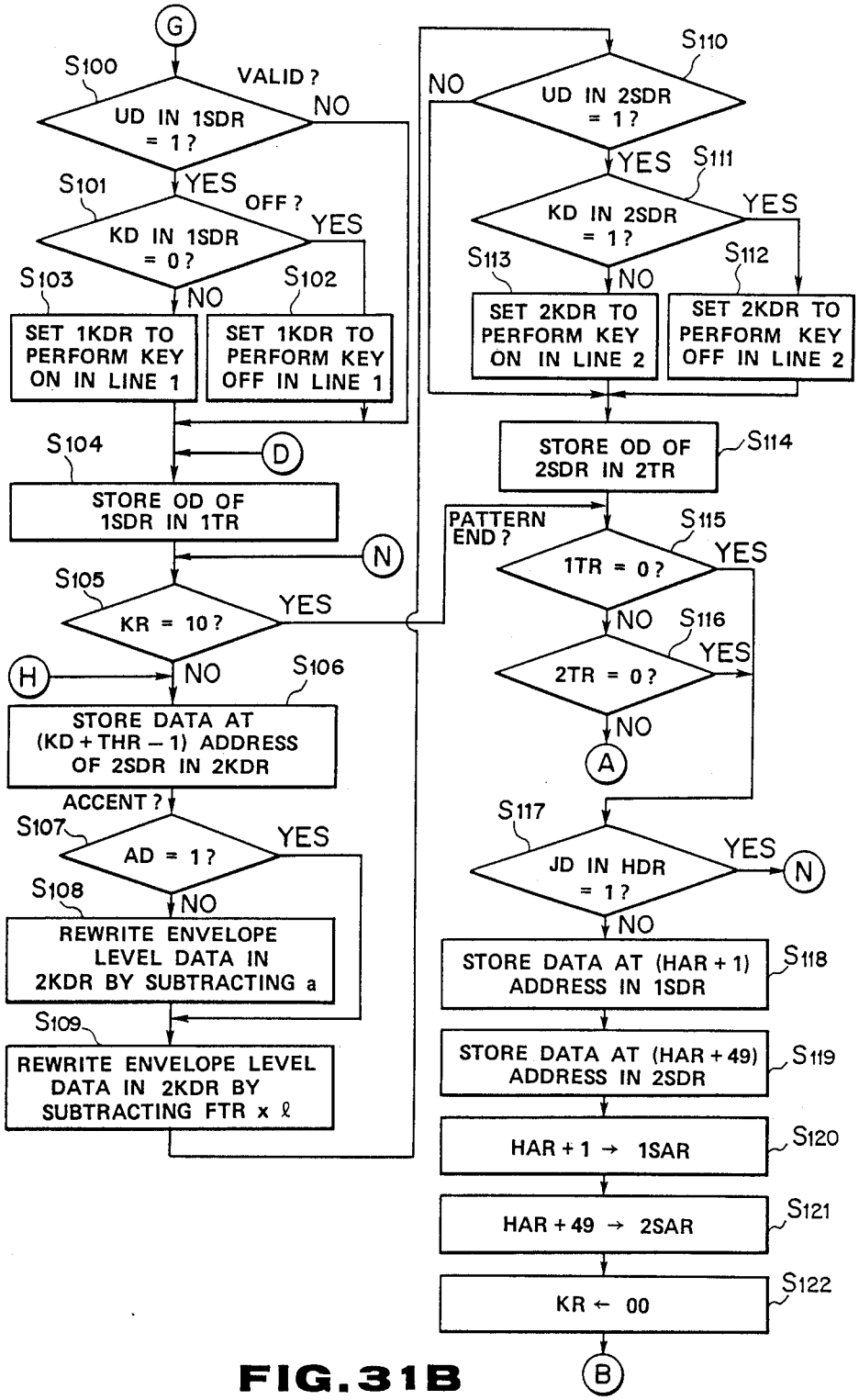
Figure 30C:
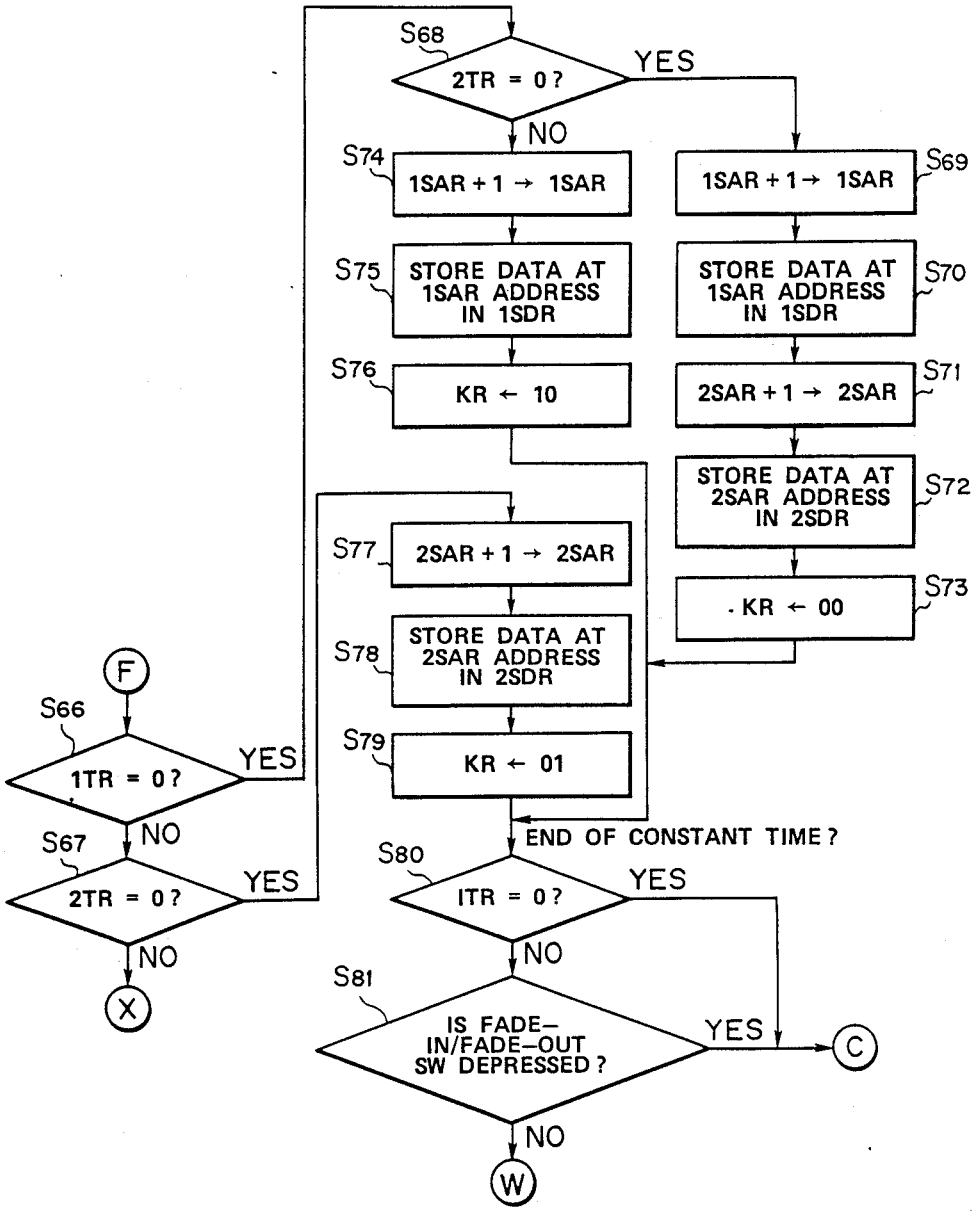
Figure 37:
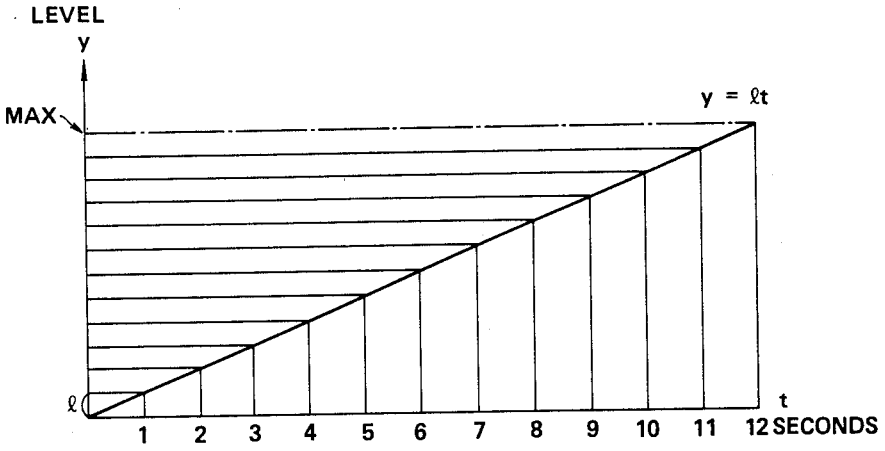
FIG. 37 is a graph showing the relationship between time and level of the non-continuous fade-in envelope processing.

FIGS. 31A to 34 are flow charts showing fade-in/fade-out processing. In FIGS. 31A and 31B, in steps $S_{91}$ and $S_{92}$, data "12" and "6" are respectively set in registers FTR and ITR. It is checked in step $S_{93}$ if data JD in register HDR is "1". If YES in step $S_{93}$, a sustain system is selected, and a fade-out address is calculated based on FD in register HDR and data in register THR (FD+THR−1), and the calculated address data is stored in register 1KDR, in step $S_{94}$. The stored data serves as fade-in tone color data. If NO in step $S_{93}$, that is, if data JD is not "1", a non-sustain system (continuous system) is selected, and it is then checked in step $S_{95}$ if data KR is "01". If NO in step $S_{95}$, an address is calculated based on data KD in register 1SDR and data in register THR (KD+THR−1), and the calculated address data is stored in register 1KDR, in step $S_{96}$. It is checked in step $S_{97}$ if data AD in register 1SDR is "1", i.e., if accent designation is made. If NO in step $S_{97}$, level data in the envelope data in register 1KDR is rewritten with a value obtained by subtracting accent value a from the level data in step $S_{98}$; otherwise, the level data is left unchanged. In step $S_{99}$, a value obtained by multiplying the value of register FTR with "l" (FTR×l) is subtracted from the level data of the envelope data in register 1KDR. In this case, "l" is a level amount which changes per second. In step $S_{99}$, fade-in envelope processing is performed. As shown in FIG. 37, a change in tone volume level over time is given by the straight line of y=lt, the level value after 12 seconds is 12l, and is a maximum value. Therefore, if the envelope of the tone color is set to be a maximum value (MAX), the tone level is 12l. When FTR×l is subtracted from 12l, the difference is plotted on y=lt. Since the present value is FTR=12, the tone level is "0" (12l−12l). Then, tone generation processing is performed in the same manner as in normal state processing. It is checked in step $S_{100}$ if data UD in register 1SDR is "1" (valid). If YES in step $S_{100}$, it is checked in step $S_{101}$ if data KD in register 1SDR is "0", i.e., if OFF data (KD=0) or ON data (KD indicates a key No.) is selected. If YES in step $S_{101}$, data in register 1KDR is Keyed off (muting) in the line 1 in step $S_{102}$. If NO in step $S_{101}$, data in register 1KDR is Keyed on (tone generation) in the line 1 in step $S_{103}$. If NO in step $S_{100}$, data OD in register 1SDR is stored in register 1TR in step $S_{104}$ after processing in step $S_{102}$ or $S_{103}$. More specifically, in steps $S_{100}$ to $S_{104}$, the line 1 pattern data is fetched and tone generation or muting is executed.

The control then enters line 2 tone generation processing. It is checked in step $S_{105}$ if data KR is "10" that is, if the step in the line 2 is not advanced by one but is continued. If NO in step $S_{105}$, an address is calculated based on data KD in register 2SDR and data in register THR (KD+THR−1), and the calculated address data is stored in register 2KDR, in step $S_{106}$. It is checked in step $S_{107}$ if data AD in register 2SDR is "1", that is, if accent designation is made. If NO in step $S_{107}$ (AD=0), level data in the envelope data in register 2KDR is rewritten with a value obtained by subtracting accent value a from the level data in step $S_{108}$; otherwise (AD=1), the level data is left unchanged. In step $S_{109}$, a value obtained by multiplying a value of register FTR with "l" (FTR×l) is subtracted from the level data in the envelope data in register 2KDR. As described above, the difference is plotted on y =lt. It is checked in step $S_{110}$ if data UD in register 2SDR is "1" (valid). If YES in step $S_{110}$, it is checked in step $S_{111}$ if data KD in register 2SDR is "0", i.e., if OFF data (KD=0) or ON data (KD indicates a key No.) is set. If YES in step $S_{111}$, data in register 1KDR is Keyed off (muting) in the line 2 in step $S_{112}$; otherwise, data in register 2KDR is Keyed on (tone generation) in the line 2 in step $S_{113}$. If NO in step $S_{110}$, data OD in register 2SDR is stored in register 2TR in step $S_{114}$ after the processing in step $S_{112}$ or $S_{113}$. More specifically, in steps $S_{106}$ to $S_{114}$, the line 2 pattern data is fetched, and tone generation/muting or tone generation sustaining processing is executed.

If YES is obtained in step $S_{105}$, that is, if data KR is "10" indicating that the line 2 is continued, after processing in step $S_{114}$, it is checked in steps $S_{115}$ and $S_{116}$ if data in registers 1TR and 2TR are respectively "0". More specifically, if the tone duration remaining time of one of the lines 1 and 2 is initially "0", i.e., pattern end (YES), the other is also regarded as a pattern end, and it is checked in step $S_{117}$ if data JD in register HDR is "1" (sustain system). If YES in step $S_{117}$, the control advances to node (N) to return to step $S_{105}$, thus executing line 2 processing. If NO in step $S_{117}$ (non-sustain system), line 1 main step data having an address obtained by adding "1" to data in register HAR (HAR+1) is stored in register 1SDR in step $S_{118}$. In step $S_{119}$, line 2 main step data having an address obtained by adding "49" to data in register HAR (HAR+49) is stored in register 2SDR. In step $S_{120}$, data obtained by adding "1" data in register HAR is stored in register 1SDR (HAR+1→1SAR). In step $S_{121}$, data obtained by adding "49" to data in register HAR is stored in register 2SAR (HAR+49→2SAR). In step $S_{122}$, data KR is set to be "00". Thereafter, the control advances to node (B) to return to step $S_{95}$. More specifically, if a pattern end is detected in the pattern end processing, the processing is not interrupted. In the sustain system, the control returns to the line 2 processing, and in the non-sustain system, the control returns to the beginning of the pattern. Since data in register FTR is not cleared, processing is continued while the tone volume is plotted on y=lt. If no pattern end is detected, the control advances to node (A), and processing shown in FIGS. 32A and 32B is executed.

Figure 32A:
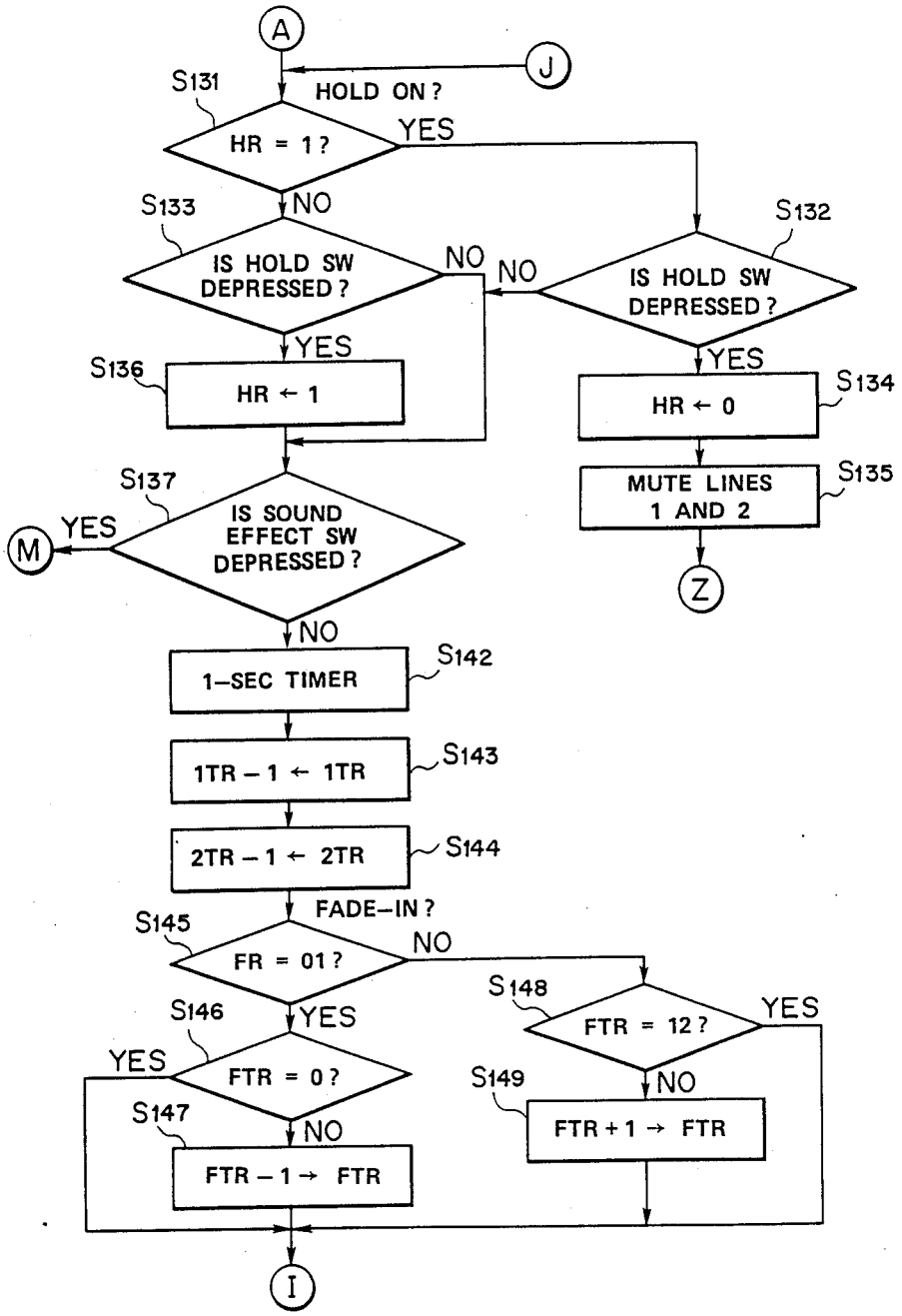
FIGS. 32A and 32B are flow charts of fade-in processing.
Figure 32B:
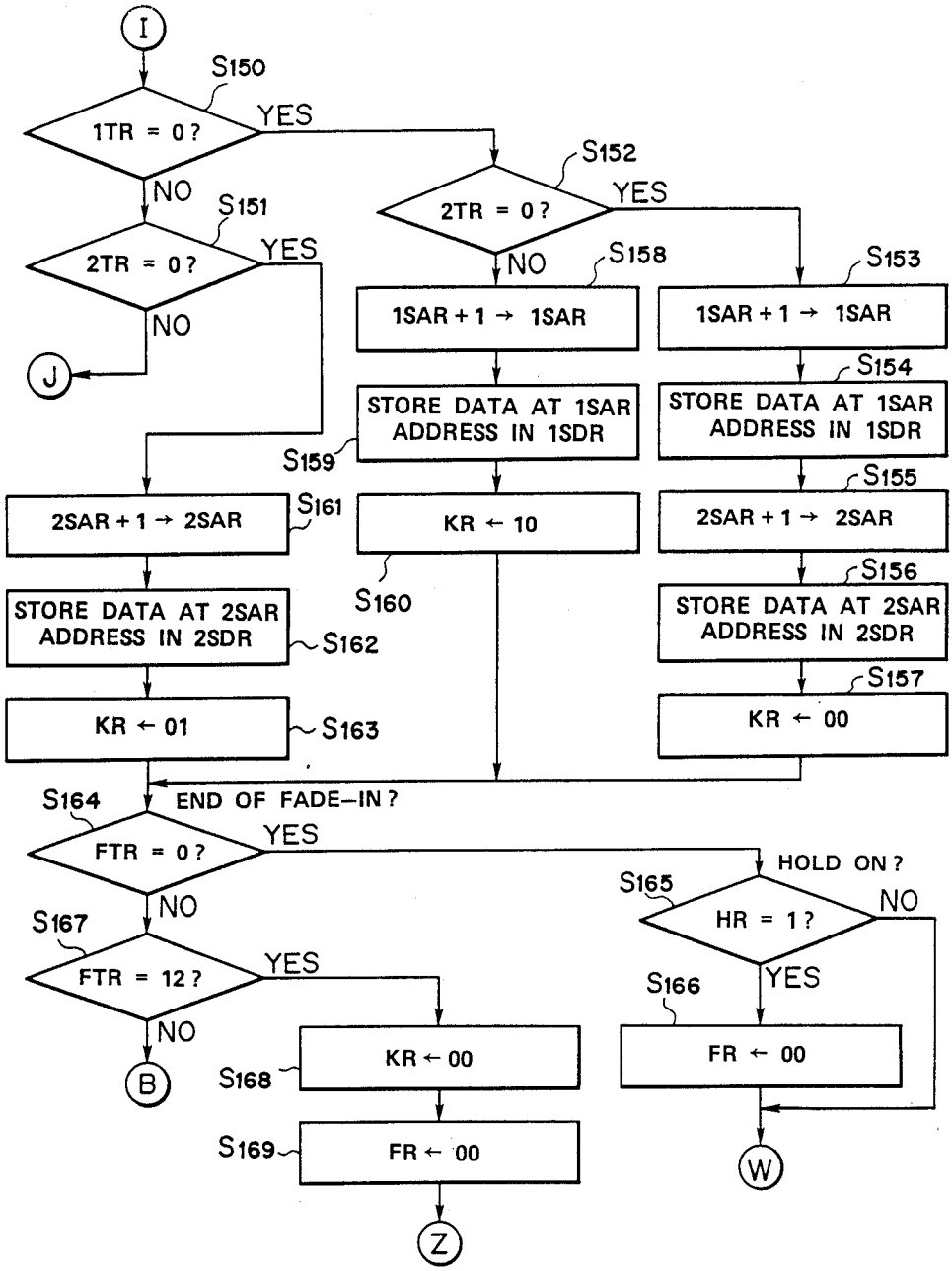

In FIGS. 32A and 32B, it is checked in step $S_{131}$ if data HR is "1" (hold ON state). Regardless of whether YES or NO is obtained in step $S_{131}$, it is checked in step $S_{132}$ or $S_{133}$ if hold switch SW10 is depressed, and data HR is rewritten. More specifically, when switch SW10 is switched from the hold ON state to the OFF state (steps $S_{131}$ and $S_{132}$), data HR is set to be "0" in step $S_{134}$, and in step $S_{135}$, the lines 1 and 2 are muted, thus completing the sound effect pattern tone generation processing. The control then advances to node (Z). When switch SW10 is switched from the hold OFF state to the ON state (steps $S_{131}$ and $S_{133}$), data HR is set to be "1" in step $S_{136}$. When data HR is set to be "1" or switch SW10 is not depressed, it is checked in step $S_{137}$ if one of sound effect switches SW1 to SW8 is depressed. If YES in step $S_{137}$, the control advances to node (M), and it is checked in step $S_{138}$ in FIG. 33 if the depressed switch has the same key No. as data NR stored in the sound effect register. If YES in step $S_{138}$, data FR is set to be "00" in step $S_{139}$ (FR←00), and the control advances to node (V) to return to step $S_{20}$, thereby re-executing sound effect pattern processing from the beginning of the normal fill-in pattern processing. If NO in step $S_{138}$, the key No. of the depressed switch is stored in data NR in step $S_{140}$. In step $S_{141}$, data FR is set to be "00" (FR←00), and the control advances to node (Y) to return to step $S_{11}$, thereby re-executing the normal sound effect pattern tone generation processing from the beginning.

If NO in step $S_{137}$, i.e., if none of sound effect switches SW1 to SW8 is depressed, 1 second is measured by a 1-sec timer in step $S_{142}$, and thereafter, tone duration data stored in registers 1TR and 2TR are updated by subtracting "1" therefrom (1TR−1→1TR, 2TR −1→2TR), in steps $S_{143}$ and $S_{144}$. More specifically, timer processing is performed in the same manner as in the normal state. It is checked in step $S_{145}$ if data FR is "01" (fade-in state). If YES in step $S_{145}$, it is checked in step $S_{146}$ if data in register FTR is "0". If NO in step $S_{146}$, the value of register FTR is updated by subtracting "1" (FTR−1→FTR) in step $S_{147}$. Whether FTR is "0" is checked in step $S_{146}$ for the following reason. That is, if the tone duration of one step is set to exceed 12 seconds (in practice, such setting is not made), the value of register FTR is prevented from being "0". If NO in step $S_{145}$, it is checked in step $S_{148}$ if data in register FTR is "12". If NO in step $S_{148}$, the value of register FTR is updated by adding "1" (FTR+1→FTR) in step $S_{149}$. If YES in step $S_{146}$ or $S_{148}$, and if the value of register FTR is updated, processing of registers 1TR and 2TR is performed in the same manner as in the normal state. That is, it is checked in steps $S_{150}$ and $S_{151}$ if data in registers 1TR and 2TR are "0". That is, whether or not tone duration times of the corresponding steps have passed is checked. If NO in both steps $S_{150}$ and $S_{151}$, the flow returns to step $S_{131}$, and the above-mentioned operation is repeated through the above-mentioned timer routine until one of the lines 1 and 2 reaches a tone duration. If YES in step $S_{150}$, i.e., if the value in register 1TR becomes "0", it is checked in step $S_{152}$ if data in register 2TR is "0". If YES in step $S_{152}$, the value of register 1SAR is updated by adding "1" (1SAR+1→1SAR) in step $S_{153}$, and line 1 step data at an address corresponding to the new value of register 1SAR is stored in register 1SDR in step $S_{154}$. In step $S_{155}$, the value of register 2SAR is updated by adding "1" (2SAR+1→2SAR), and line 2 step data at an address corresponding to the new value of register 2SAR is stored in register 2SDR in step $S_{156}$. In step $S_{157}$, data KR is set to be "00". More specifically, in steps $S_{153}$ to $S_{157}$, the line 1 and 2 step data are advanced by one. If NO in step $S_{152}$, the value of register 1SAR is updated by adding "1" (1SAR+1→1SAR) in step $S_{158}$, and line 1 step data at an address corresponding to the new value of register 1SAR is stored in register 1SDR in step $S_{159}$. In step $S_{160}$, data KR is set to be "10". More specifically, data KR is set such that the line 1 step data is advanced by one, and the line 2 continues the timer routine. If YES in step $S_{151}$, the value of register 2SAR is updated by adding "1" (2SAR+1→2SAR) in step $S_{161}$, and line 2 step data at an address corresponding to the new value of register 2SAR is stored in register 2SDR in step $S_{162}$. In step $S_{163}$, data KR is set to be "01". More specifically, data KR is set such that the line 2 step data is advanced by one, and the line 1 continues the timer routine.

It is then checked in step $S_{164}$ if data in register FTR is "0". If FTR="0", this means that the envelope has reached the maximum level. In this case, it is checked in step $S_{165}$ if data HR is "1" (hold ON). If YES in step $S_{165}$, data FR is set to be "00" in step $S_{166}$; otherwise, the control directly advances to node (W) to advance to the normal flow in step $S_{25}$. When the hold OFF state is detected, the flow advances to the normal flow while leaving data FR to be "01" since the processing shown in FIG. 16 is executed. If NO in step $S_{164}$, it is checked in step $S_{167}$ if data in register FTR is "12" (end of fade-out). If NO in step $S_{167}$, the flow advances to node (B) to return to step $S_{95}$; otherwise, data KR and FR are set to be "00" in steps $S_{168}$ and $S_{169}$, respectively. The control then advances to node (Z) to return to step $S_2$, thus detecting the switch operation.

A fade-out processing flow will be described below. The fade-out processing starts from node (C) shown in FIG. 30C, and advances to the flow shown in FIG. 33. In steps $S_{171}$ and $S_{172}$, data "10" is set in data FR, and data "0" is set in register FTR, thus performing processing for using the flow of non-sustain system. It is checked in step $S_{173}$ if data JD in register HDR is "1" (sustain system). If NO in step $S_{173}$ the control advances to node (B) to return to step $S_{95}$; otherwise, a step in which the sustain flag is set is searched from the envelope data in register 1KDR in step $S_{174}$. In step $S_{175}$, the searched step is incremented by "1", and the control advances to release processing. In the fade-out processing, if data "10" is set in FR, FTR+1→FTR is calculated after it is determined in step $S_{145}$ that FR is "01". Therefore, the value in register FTR is increased along with the lapse of time. The envelope level in register 1KDR is decreased along with the lapse of time, and becomes "0" after 12 seconds. The fade-out flow is then ended after it is determined in step $S_{148}$ that the value in register FTR is "12". In the case of the sustain system, the sustain flag is searched using the envelope data in register 1KDR. In FIG. 23 the sustain flag is set in the second step. When the data of the next step is executed, since the release time is preset to be 12 seconds, a sustain tone slowly fades out in 12 seconds.

In this embodiment, the tone volume of an effect tone can be automatically controlled by switch operations. In the case of an electronic musical instrument, an automatic rhythm, chord, or bass function may be controlled. Thus, upon introduction or ending of a performance, an introduction or ending phrase need not be created in units of tones. Therefore, the performance can be smoothly started and ended.

In the above embodiment, various other effect tone patterns may be used. Fade-in and fade-out times or sustain level duration time can be changed, and are not limited to those in the above embodiment.

In the above embodiment, the main effect tone pattern and fill-in effect tone pattern are selected and executed. However, at least two first and second effect tone patterns having different patterns need only be executed. The contents of effect tones and types of pattern can be arbitrarily determined, and are not limited to those in the above embodiment. In addition, a fill-in effect tone time period can be arbitrarily set. In order to designate a fill-in effect tone pattern, the same switch as that for designating the main effect tone pattern is used. However, a switch exclusively used for selecting the fill-in pattern can be arranged.

What is claimed is:

1. An effect tone generating apparatus, comprising:

waveform generating means for generating a plurality of waveform data constituting an effect tone representing a scene;

pattern generating means for generating at least first and second effect tone patterns indicating generation timings of the waveform data from said waveform generating means constituting the effect tone;

manually operative means for manually selecting one of the first and the second effect tone patterns; and pattern selections means, for, when the second effect tone pattern is selected by said manually operative means during generation of an effect tone based on the first effect tone pattern output from the pattern generating means, starting generation of an effect tone based on the second effect tone pattern output from the pattern generating means, and for, when a pattern end of the second effect tone pattern is detected, restarting generation of the effect tone based on the first effect tone pattern.

2. An apparatus according to claim 1, wherein a waveform represented by said waveform data generated by said waveform generating means has a non-sustain envelope.

3. An apparatus according to claim 1, wherein a waveform represented by said waveform data generated by said waveform generating means has a sustain envelope.

4. An apparatus according to claim 1, wherein the second effect tone pattern is shorter than the first effect tone pattern.

5. An apparatus according to claim 1, wherein said pattern generating means re-generates the first effect tone pattern from the beginning when a pattern end of the first effect tone pattern is detected.

6. An apparatus according to claim 1, wherein said pattern selection means starts generation of the effect tone based on the second effect tone pattern by operating a common switch included in said manually operative means which switch selects the first effect tone pattern.

7. An effect tone generating apparatus, comprising:

waveform generating means for generating a plurality of waveform data constituting an effect tone representing a scene;

pattern generating means for generating an effect tone pattern indicating a generation timing of the waveform data from said waveform generating means constituting the effect tone;

manually operative means for manually starting generation of the effect tone pattern; and pattern control means for, when no effect tone is generated based on the effect tone pattern and said manually operative means is operated, starting generation of an effect tone based on the effect tone pattern output from the pattern generating means, and for, when a pattern end of the effect tone pattern is detected, stopping generation of the effect tone.

8. An apparatus according to claim 7, wherein a waveform represented by said waveform data generated by said waveform generating means has a non-sustain envelope.

9. An apparatus according to claim 7, wherein a waveform represented by said waveform data generated by said waveform generating means has a sustain envelope.

10. An effect tone generating apparatus, comprising:

waveform generating means for generating a plurality of waveform data constituting an effect tone representing a scene;

pattern generating means for generating an effect tone pattern indicating a generation timing of the waveform data from said waveform generating means;

tone volume level control means for controlling a tone volume level of the effect tone generated based on the plurality of waveform data each output from said waveform generating means at the timings determined by said effect tone pattern; and designation means for designating a change mode of the tone volume level of said tone volume level control means.

11. An apparatus according to claim 10, wherein when said designation means designates a fade-in mode as the change mode, the effect tone begins to be generated while the tone volume level is increased at a change rate lower than a normal rate in accordance with a control by said tone volume level control means.

12. An apparatus according to claim 10, wherein when said designation means designates a fade-out mode as the change mode, generation of the effect tone is stopped while the tone volume level is decreased at a change rate lower than a normal rate in accordance with a control by said tone volume level control means.

13. An apparatus according to claim 10, wherein when said designation means designates a fade-in and fade-out mode as the change mode, the effect tone begins to be generated while the tone volume level is increased at a change rate lower than a normal rate, and after the tone volume level is maintained at a constant level, generation of the effect tone is stopped while the tone volume level is decreased at a change rate lower than a normal rate in accordance with a control by said tone volume level control means.

14. An apparatus according to claim 10, wherein a waveform represented by said waveform data generated by said waveform generating means has a non-sustain envelope.

15. An apparatus according to claim 10, wherein a waveform represented by said waveform data generated by said waveform generating means has a sustain envelope.

16. An apparatus according to claim 10, wherein said pattern generating means re-generates the effect tone pattern from the beginning when a pattern end of the effect tone pattern is detected.

17. An effect tone generating apparatus, comprising:

waveform generating means for generating a plurality of waveform data constituting an effect tone representing a scene;

pattern generating means for generating an effect tone pattern indicating a generation timing of the waveform data from said waveform generating means;

digital envelope waveform generating means for generating an envelope waveform as digital data for controlling a tone volume level of the effect tone generated based on the plurality of waveform data each output from said waveform generating means at the timings determined by said effect tone pattern; and designation means for designating the envelope waveform of said envelope waveform generating means.

18. An apparatus according to claim 17, wherein said envelope waveform generating means generates a plurality of envelope waveforms having different attack times.

19. An apparatus according to claim 17, wherein said envelope waveform generating means generates a plurality of envelope waveforms having different release times.

20. An effect tone generating apparatus, comprising:

waveform generating means for generating a plurality of waveform data constituting an effect tone representing a scene;

a plurality of tone field channels;

envelope waveform generating means for generating a plurality of various envelope waveforms to be imparted on the waveform data for each of the plurality of tone field channels; and tone generation control means for generating an effect tone in which the various envelope waveforms are independently imparted on the waveform data for each of said plurality of tone field channels.

21. An apparatus according to claim 20, wherein a waveform represented by said waveform data generated by said waveform generating means has a non-sustain envelope.

22. An apparatus according to claim 20, wherein a waveform represented by said waveform data generated by said waveform generating means has a sustain envelope.

* * * * *